United States Patent [19]

Conrad

[11] 4,427,158

[45] Jan. 24, 1984

[54] APPARATUS FOR REMOVING FILLED PACKAGES FROM A FILAMENT WINDER AND INSTALLING EMPTY TUBES ON THE WINDER

[75] Inventor: Peter Conrad, Charlotte, N.C.

[73] Assignee: Fiber Industries, Inc., Charlotte, N.C.

[21] Appl. No.: 387,645

[22] Filed: Jun. 11, 1982

[51] Int. Cl.[3] ..... B65H 67/04; B65H 54/26

[52] U.S. Cl. ..... 242/35.5 A; 279/1 R

[58] Field of Search ..... 242/35.5 A, 35.5 R, 242/18 R; 57/266, 268, 270, 271

[56] References Cited

U.S. PATENT DOCUMENTS

| | | | |
|---|---|---|---|
| 3,791,126 | 2/1974 | Kose et al. | 242/35.5 A |
| 3,811,631 | 5/1974 | Mayer et al. | 242/35.5 A X |
| 3,820,730 | 6/1974 | Endo et al. | 242/35.5 A X |
| 3,964,723 | 6/1976 | Schippers et al. | 242/35.5 A |
| 3,987,974 | 10/1976 | Mayer | 242/35.5 A |
| 4,007,882 | 2/1977 | Isoard | 242/35.5 A X |
| 4,023,743 | 5/1977 | Schippers | 242/35.5 A |
| 4,069,983 | 1/1978 | Muramatsu et al. | 242/35.5 A X |
| 4,153,211 | 5/1979 | Lenk et al. | 242/35.5 A |
| 4,340,187 | 7/1982 | Schippers et al. | 242/35.5 A |
| 4,351,494 | 9/1982 | Schippers et al. | 242/35.5 A |

*Primary Examiner*—Stanley N. Gilreath
*Attorney, Agent, or Firm*—H. M. Adrian, Jr.

[57] ABSTRACT

A doffing/donning apparatus is used in combination with a row of winders each of which winds filamentary material upon a tube carried by a rotary spindle of the winder to form a package. The apparatus comprises a carrier mounted for movement generally parallel to and above the row of winders. A column is mounted on said carrier for horizontal movement. A package exchange arm is mounted on said column for up-and-down movement and is alignable with the winder spindle so that the package can be transferred to the package exchange arm. A tube exchange arm is mounted on the column for up-and-down movement and is alignable with the spindle so that a tube on the tube exchange arm can be transferred to the spindle. A shuttle is spaced horizontally from and vertically above the row of winders, and includes a package transfer arm and a tube transfer arm. The package exchange and tube exchange arms are moved along the column to the level of the shuttle. The column is moved horizontally toward the shuttle so that the package can be transferred from the package exchange arm to the package transfer arm and a tube can be transferred from the tube transfer arm to the tube exchange arm. The shuttle is transferred to a remote station where the package is removed from the package transfer arm and a tube is inserted on the tube transfer arm.

22 Claims, 32 Drawing Figures

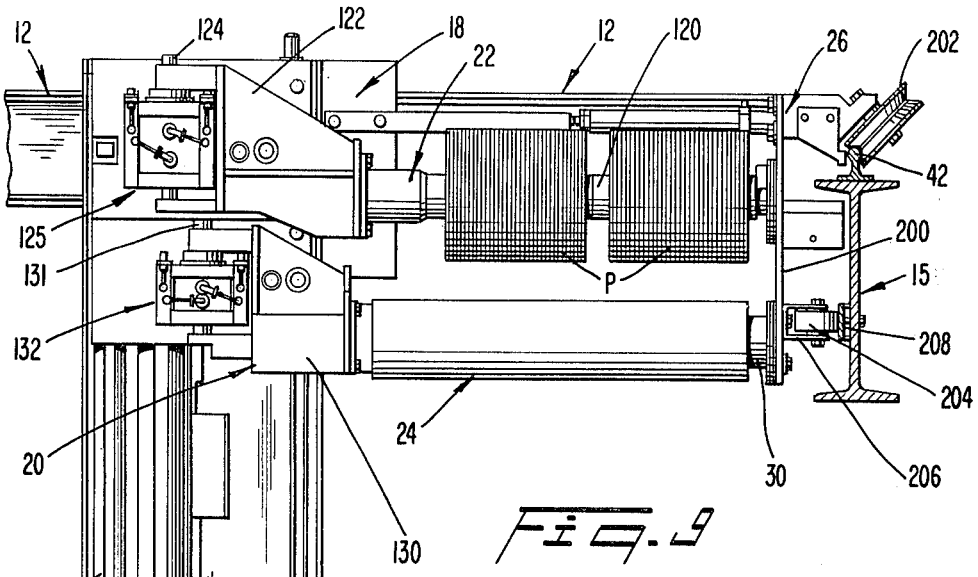
Fig. 9
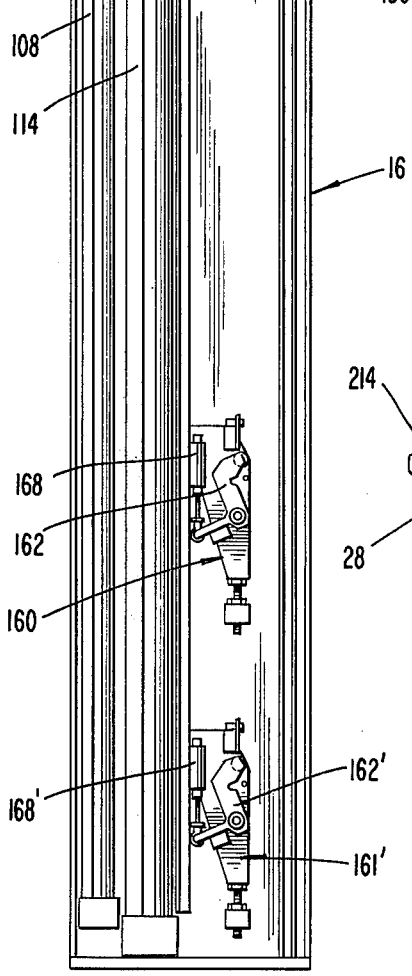
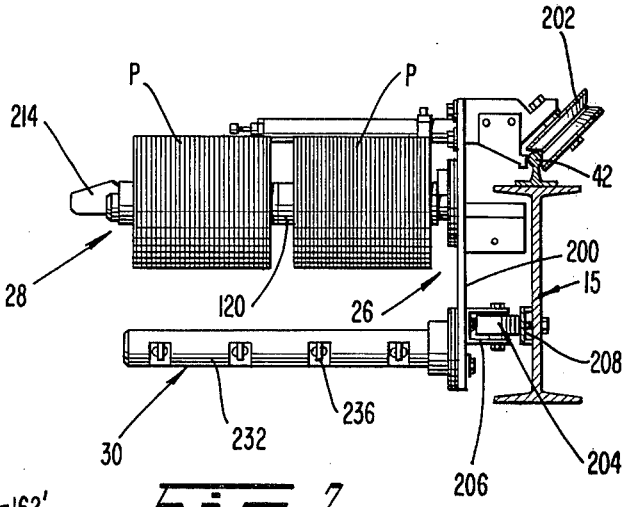
Fig. 7

APPARATUS FOR REMOVING FILLED PACKAGES FROM A FILAMENT WINDER AND INSTALLING EMPTY TUBES ON THE WINDER

BACKGROUND AND OBJECTS OF THE INVENTION

The present invention relates generally to the high speed winding of filamentary material onto bobbins or tubes to form packages of filamentary material. More particularly, the invention relates to the automated removal of full packages and replacement thereof by empty tubes.

The manufacture of man-made or synthetic filament yarns is typically achieved by extruding a molten polymer, such as polyester, polyamide, etc., through hole(s) in a spinneret and then cooling the filament(s) thus formed. Thereafter, the filaments may be gathered together to form a multi-filament yarn and, possibly after further treatment, are wound onto a tube so that a yarn package is formed.

Winding of the yarn is performed mechanically by winders which rotate one or more tubes on a spindle to wind-up the yarn while traversing the yarn along the tube axis to achieve a uniform thickness of yarn being wound. When winding is completed, a filled tube, hereinafter termed a "package", must be doffed and replaced by an empty tube for a subsequent winding operation.

Such a doffing/donning operation is often performed manually by an operator who (i) severs the yarn; (ii) stops or disengages the rotary drive to the packages; (iii) replaces the packages with empty tubes; (iv) re-establishes the rotary drive; and (v) rethreads the yarn onto the empty tubes. Severing of the filamentary yarn is typically performed with scissors while the inlet of a suction or aspirator gun is held against the yarn at a location upstream of the point of severing. Once the yarn is severed, the tail end is wound onto the yarn package, while the newly formed leading end is sucked into the aspirator and transported to a waste collector.

Replacement of the packages with empty tubes is performed when rotation of the filled package has terminated, whereupon the operator activates an ejection device that pushes packages off the spindle and grasps the filled packages and pulls them from the spindle. The operator then mounts the packages on a transport device, and pushes empty tubes onto the spindle. It would be desirable to eliminate the physical handling of filled packages by operators, not merely from an economical labor-saving standpoint, but also to prevent damage and staining of the yarn if touched by the operator's hands, as well as to permit the winding of large packages that are too heavy to be handled by an operator.

It has heretofore been proposed to mechanize the doffing/donning operation by providing an automated system for removing the filled packages from the winder spindle, inserting empty tubes on the spindle, and transporting the packages to a downstream station for further handling.

For example, a floor-mounted robot-type of mechanism has been developed and employed which (i) cuts and aspirates yarn, (ii) shuts off the spindle motor, (iii) removes the filled packages, (iv) inserts empty tubes onto the spindle, (v) restarts the winder, (vi) rethreads the tubes, and (vii) transports the filled packages to a downstream station. The robot is quite large and extends across three or four positions (winders) even while servicing only one, thereby interfering with any service or maintenance that must be performed on those three or four positions. In order to enable the robot to (i) cut and aspirate yarns at each station, (ii) receive packages and (iii) install empty tubes, it is necessary to achieve a high degree of alignment between the robot and winder. This requires sophisticated equipment, such as a sensor on the robot which senses a target (e.g., a light beam) on the winder to brake the robot. The robot is designed to slightly overshoot the position of alignment and thus must back-track at half speed until again sensing the target. After again overshooting the target, the robot advances at a yet slower speed until resensing the target and halting at an aligned position. Besides requiring sophisticated equipment, such a procedure is time-consuming. In this regard, it will be appreciated that the quantity of robots needed in a plant depends in great part upon the rapidity with which the robot can service each position. The need to achieve precision alignment extends the servicing period. Additional time consumption is caused by the large number of steps which must be performed by the robot, including shutting-off the winder, cutting and aspirating the yarn, and transporting the filled packages to a downstream station.

Other types of automated tube exchange mechanisms are disclosed in U.S. Shippers et al Pat. No. 3,964,723 issued June 22, 1976 and U.S. Shippers Pat. No. 4,023,743 issued May 17, 1977. In the latter patent, a spool-changing carriage 22 moves along rails positioned below a line of winders. A movable spool conveyor extends beneath the carriage. This carriage carries a gripper which simultaneously removes filled packages and captures empty tubes from the spool conveyor. Then the gripper rotates 180° and simultaneously transfers the empty tubes onto the winder spindle and transfers the filled packages to the conveyor.

It will be appreciated that such an arrangement minimizes the accessibility of the winders. That is, by mounting the carriage and conveyor beneath the winders, the winders must be raised to a level which is more difficult for maintenance personnel to reach. Such accessibility is further hampered by the presence of the conveyor, conveyor tracks, and carriage tracks, etc., which are disposed in the immediate vicinity of the winders. Furthermore, the carriage/conveyor arrangement cannot be retro-fit onto existing lines, but rather requires that a new installation be constructed to accommodate the carriage/conveyor support tracks.

The empty tube gripper cylinder employed in that system includes a series of internal fluid-actuated clamping elements for gripping the empty tubes. Such a mechanism greatly exacerabates the overall complexity of the equipment.

The carriage of the above-described system is capable of servicing only winder spindles disposed at a common elevation. On the other hand, many winders currently in use employ spindles positioned at different elevations.

The principal object of the present invention is to provide a method and an apparatus to automatically remove yarn packages and install empty tubes on spinning machine winders without the need for operator presence or attention.

Another object of the present invention is to provide a method and an apparatus for removing yarn packages from the spinning machine winders that are too heavy for humans to handle.

A further object of this invention is to provide a method and an apparatus to transport the packages automatically away from the spinning area and to bring in the empty tubes for automatic installation on winder spindles.

A still further object of the present invention is to provide a means and an apparatus for delivering the packages to an area downstream of spinning where the packages may be automatically picked-up, transported, tested, inspected, sorted and packaged for shipment.

Another object of this invention is to provide an automatic doffing apparatus that takes little space in the spinning area that conveys the packages out of the spinning area above head height so as not to interfere with service and maintenance personnel on the area floor.

A still further object of this invention is to provide an automatic doffing apparatus serving a large number of winder positions and accomplishing this by separating the actions of doffing the winders from the action of transporting the doffed packages away from the spinning area at great speed and paralleling these actions so they overlap or are taking place simultaneously, thus reducing the overall doffing cycle time.

A further object of the present invention is to provide an automatic doffing apparatus that is safe and compatible with the occasional presence of the service and maintenance personnel where the doffing element is slow moving and not threatening to humans and where the fast moving element transporting the packages from the spinning area is safely placed overhead well above any human traffic below.

A still further object of this invention is to provide an automatic doffing apparatus that although capable of being accurately placed in line with a winder spindle is tolerant of considerable misalignment while accepting packages from the winder or installing close tolerance tubes on the winder spindle.

SUMMARY OF THE INVENTION

The present invention relates to apparatus and methods in combination with a row of winders, each of which winds filamentary material upon a tube supported for rotation about a rotary axis of the winder to form a package. The apparatus services each winder by removing a package from the winder and replacing the package with a tube. The apparatus comprises a carrier suspended from above the row of winders for movement generally parallel to the row of winders. A mechanism is provided for positioning the carriers selectively at locations for servicing respective winders. A package exchange mechanism includes an arm and is mounted on the carrier for up-and-down movement. The arm is positionable opposite the rotary axis of a winder being serviced so that the package can be transferred from the winder to the package exchange arm. A tube exchange mechanism includes an arm and is mounted on the carrier for up-and-down movement and is positionable opposite the axis so that a tube exchange arm can be transferred to the winder. A shuttle is spaced above the row of winders and includes a package transfer arm and a tube transfer arm. Mechanism is provided for vertically moving the package exchange mechanism and the tube exchange mechanism to the general level of the shuttle. Mechanism is provided for effecting transfer of the package from the package exchange arm to the package transfer arm, and for effecting transfer of a tube from the tube transfer arm to the tube exchange arm. A mechanism is provided for propelling the shuttle to a remote station where the package is removed from the package transfer arm, and a tube is installed on the tube transfer arm.

Preferably, a column is mounted on the carrier for movement toward and away from the row of winders. The package exchange mechanism and the tube exchange mechanism are mounted for vertical movement on the column, with the shuttle being spaced vertically and horizontally from the row of winders.

The package exchange arm and the tube exchange arm are preferably each mounted for swiveling between horizontal positions spaced 180° so as to generally face the row of winders in one position and the shuttle means in the other position.

A positioning mechanism is preferably provided on the column for locating the package exchange mechanism and the tube exchange mechanism in positions in line with the winder spindle. In cases where the winders are arranged in two rows, one above the other, an upper positioning mechanism is retractible to enable the package exchange mechanism and the tube exchange mechanism to travel downwardly therebeyond to service the lower spindles.

The tube exchange arm preferably comprises a hollow cylinder mounted for rotation about its longitudinal axis. A plurality of resiliently flexible projections, such as bristles, extend inwardly into a center bore of the cylinder. Inner ends of the projections define an aperture having a diameter less than the diameter of the tubes. The cylinder is rotated about its longitudinal axis as the cylinder is telescoped over a tube, such that inner ends of the projections are flexed generally tangentially in response to engagement with an outer periphery of the tube. Such an arm has utility in fields other than the production of filamentary material, wherein an object of any type and configuration is to be gripped.

The tube transfer arm on the shuttle preferably includes a lock for resisting rotation of a tube disposed on the tube transfer arm when the tube exchange cylinder is rotated in one direction during longitudinal engagement of the cylinder with the tube transfer arm. The lock disengages during opposite rotation of the cylinder during longitudinal disengagement of the cylinder from the tube transfer arm.

The package exchange arm preferably comprises a hollow member onto which the packages are slid. The package transfer arm comprises a rod sized to be received telescopingly in the hollow member. The rod has a package elevating plate projecting upwardly therefrom which enters a longitudinal slot of the hollow member to lift the packages off the hollow member.

The mechanism for positioning the carrier in selective positions preferably comprises a plurality of sensible elements on a track upon which the carrier travels. Each element corresponds to a winder position. A sensing mechanism is mounted on the carrier for sensing each element so that the location of the carrier can be monitored. The carrier also includes a movable member which can be moved into engagement with a selected one of the elements to locate the carrier relative thereto.

Preferably, the package and tube are transferred from the carrier to the shuttle simultaneously in order to shorten the operation cycle of the apparatus.

THE DRAWINGS

These objects and advantages of the invention will become apparent from the following detailed description of a preferred embodiment thereof, in connection with the accompanying drawings in which like numerals designate like elements, and in which:

FIG. 1 is a side elevational view of a column mounted on a mobile carrier, with a package exchange arm and tube exchange arm mounted in upper positions on the column;

FIG. 7 is a view similar to FIG. 6 after the package exchange arm and the tube exchange arm have been engaged telescopingly with the package transfer arm and the tube transfer arm, respectively, of the shuttle;

FIG. 9 is a side elevational view of the shuttle after transfer has been made with the package exchange arm and the tube exchange arm, wherein the package transfer arm carries two packages, and the tube transfer arm is empty;

FIG. 10 is a cross-sectional view through the column depicting a pair of air cylinders which vertically move the package exchange mechanism and the tube exchange mechanism;

Figure 2:
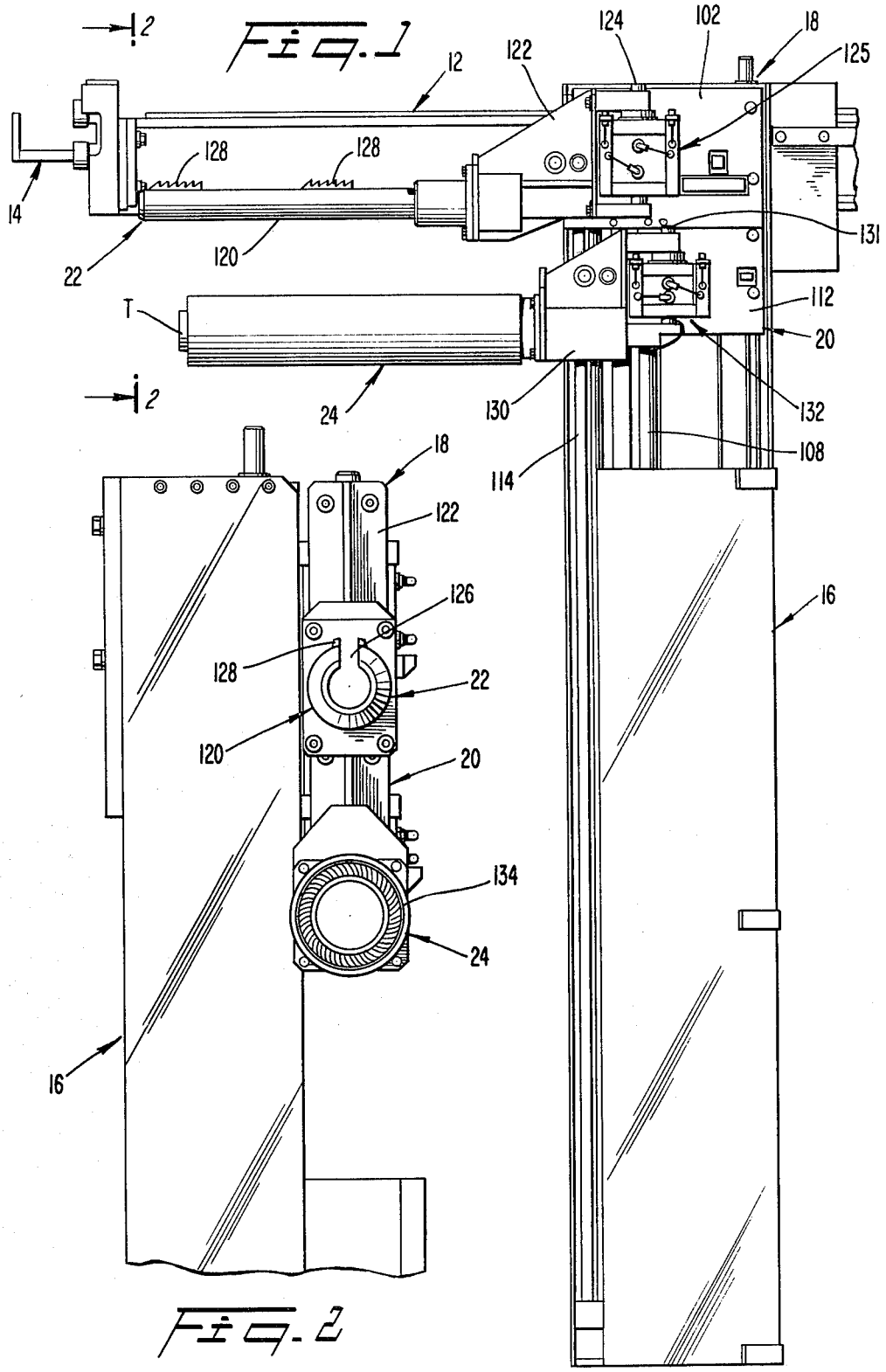
FIG. 2 is a cross-sectional view taken along line 2—2 in FIG. 1.

FIGS. 23A to 23I schematically depict various positions of the apparatus during the transfer of packages and tubes between a winder and shuttle according to the invention.

DETAILED DESCRIPTION OF A PREFERRED EMBODIMENT OF THE INVENTION

In accordance with the present invention, a doffing/donning system, depicted schematically in FIGS. 23A–23I, is arranged adjacent a row of winders 10 to remove one or more packages P, i.e., tubes on which filamentary material such as yarn has been wound, and replace same with a corresponding quantity of empty tubes T. Basically, the system comprises a carrier 12 which travels parallel to the row of winders in a horizontal direction (i.e., into and from the paper in FIG. 23) along fixed overhead tracks 14, 15. The carrier 12 travels above the row of winders at a level above service and maintenance personnel working therebeneath, e.g., at least seven feet thereabove.

Mounted on the carrier 12 for movement toward and away from the winders (i.e., to the right or left in FIG. 23), is an upright column 16. Mounted on the column 16 for independent vertical travel are a pair of upper and lower heads 18, 20 carrying a package exchange arm 22 and a tube exchange arm 24, respectively. The arms each rotate in a horizontal plane to face toward or away from the row of winders 10 (compare FIGS. 23B and 23G).

Figures 23A, 23B, 23C, 23D, 23E, 23F, 23G, 23H, 23I:
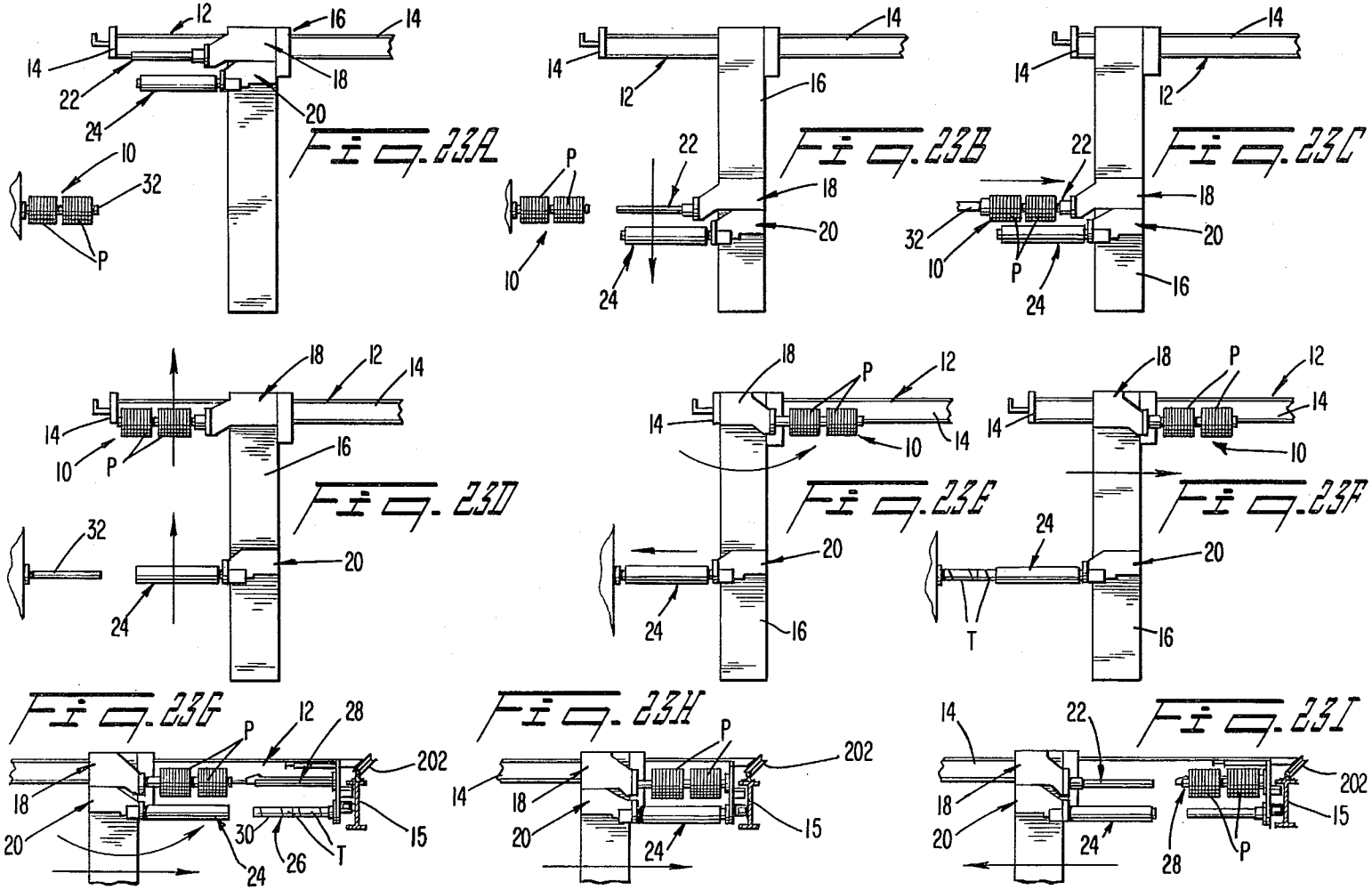

Mounted on one of the tracks 15 for movement in a direction parallel to travel of the carrier 12 is a transport shuttle 26 (FIG. 23G). Projecting from the shuttle are a package transfer arm 28 and a tube transfer arm 30. Those transfer arms 28, 30 are alignable simultaneously with the exchange arms 22, 24, respectively, on the column 16.

When a particular winder 10 requires doffing, the carrier 12 is dispatched to that winder, and the column 16 is advanced toward the winder 10 (FIG. 23A). The heads 18, 20 descend, and the package exchange arm 22 becomes aligned with the spindle 32 of the winder containing the packages P (FIG. 23B). Thereupon, the column 16 is advanced so that the end of the package exchange arm 22 lies closely adjacent the end of the spindle, and the standard package eject mechanism on the winder 10 pushes the packages onto the package exchange arm 22 (FIG. 23C). With this transfer completed, the column 16 is backed-off slighly to miss the overhanging portion of winder 10, and the package exchange arm 22 is raised and rotated 180° (FIGS. 23D, 23E). The tube exchange arm 24 is raised into alignment with the spindle 32 (FIG. 23D). This tube exchange arm 24 comprises a hollow cylinder in which empty tubes T are carried. By advancing the column 16, the spindle 32 telescopingly enters the cylinder and receives the tubes (FIG. 23E). The column 16 backs-off and the empty tube exchange arm is raised and rotated 180° (FIG. 23G).

The column 16 is retracted toward the shuttle 26 which has, in the meantime, arrived in a prescribed position relative to the carrier 12. The package transfer arm 28 and the tube transfer arm 30 are aligned with the package exchange arm 22 and tube exchange arm 24, respectively. The tube transfer arm 30 of the shuttle 26 carries a set of empty tubes T. By moving the column toward the shuttle, there simultaneously takes place a transfer of the packages P to the package transfer arm 28 and a transfer of empty tubes T to the tube exchange arm 24 (FIGS. 23H, I).

The column 16 now backs away from the shuttle 26 (FIG. 23I), the exchange arms 22, 24 are rotated by 180°, and the carrier is dispatched to a subsequent winder to be doffed. The shuttle 26 is dispatched to a downstream servicing station where the packages P are removed from the package transfer arm 28 and empty tubes are placed onto the tube transfer arm 30.

Referring now to the remaining figures, the invention will be described in greater detail. The carrier-support tracks 14, 15 include parallel horizontally extending surfaces 40, 42 (FIG. 15) upon which the ends of the carrier are supported. The tracks 14, 15 are stationary and extend parallel to the row of winders 10 at a level above the heads of workers passing therebelow, e.g., at least seven feet thereabove.

Figure 15:
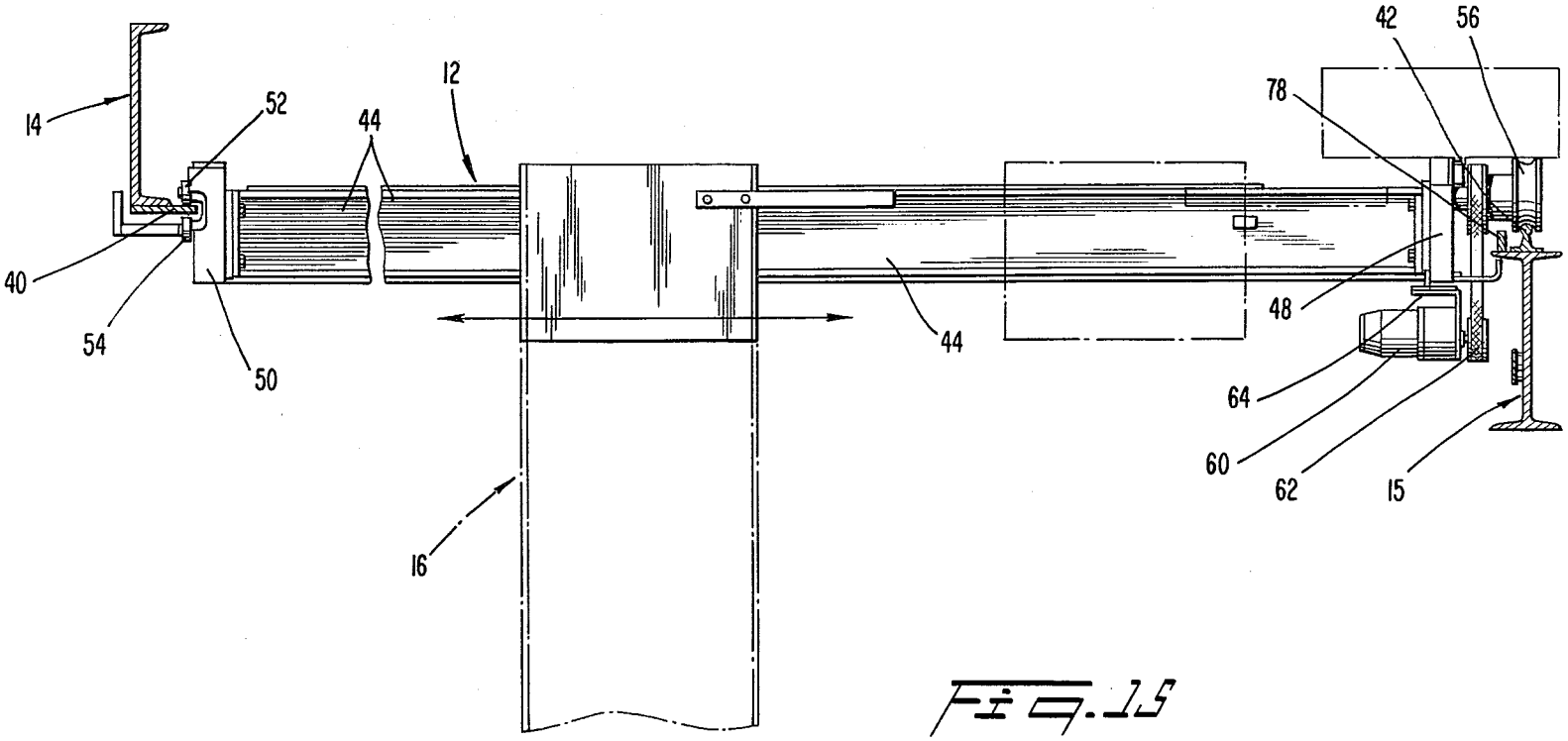
FIG. 15 is a front view of the column mounted on the carrier, depicting the drive mechanism for the carrier.

The carrier 12 comprises a skeletal framework formed of front and rear parallel beams 44, 46 (FIG. 16) which are interconnected by end structures 48, 50. On one of the end structures 50 are mounted pairs of vertically spaced guide wheels 52, 54 (FIG. 15). Those wheels are mounted on opposite sides of the track surface 40 for rotation about horizontal axes, with the upper wheel 52 bearing against that surface 40.

On the end structure 48 are mounted a pair of horizontally spaced wheels 56, 58 (FIGS. 15, 16) which ride atop the track surface 42. One of the wheels 56 is power driven by means of an electric drive motor 60 and drive belt 62 to traverse the carrier along the tracks in response to a suitable actuating signal. The motor 60 is mounted on the end structure 48 by means of a bracket 64.

Also mounted on the end structure 48 of the carriage 12 is a carriage lock mechanism 68 (FIG. 16) which locks-in the carriage 12 at any one of a plurality of positions corresponding to the particular winder 10 being serviced. The lock mechanism 66 comprises a pair of fingers 68, 70 mounted to the end structure 48 for rotation about a vertical pin 72. A pair of double-acting pneumatic cylinders 74, 76 are mounted on the end structure 48 and are connected respectively to the fingers 70, 68. Mounted on the track 15 are a series of fixed locator pins 78 (FIG. 15) corresponding to the various winder positions. A conventional sensor 80 carried by the end structure 48 is arranged to travel about the pins and produce actuation of the rams 74, 76 when the appropriate pin is reached. This can be achieved by connecting the sensor to a counter which counts pins and stops the drive motor and actuates the cylinders 74, 76 when a preselected count is reached. When the fingers 68, 70 are in a retracted mode (FIG. 16), they pass by the pins 78. However, when the cylinders are actuated the free ends of the fingers 68, 70 are converged toward opposite sides of the selected pin. When the pin has been gripped by both fingers, the column 16 will be properly and accurately positioned relative to the selected winder 10.

Figure 9A:
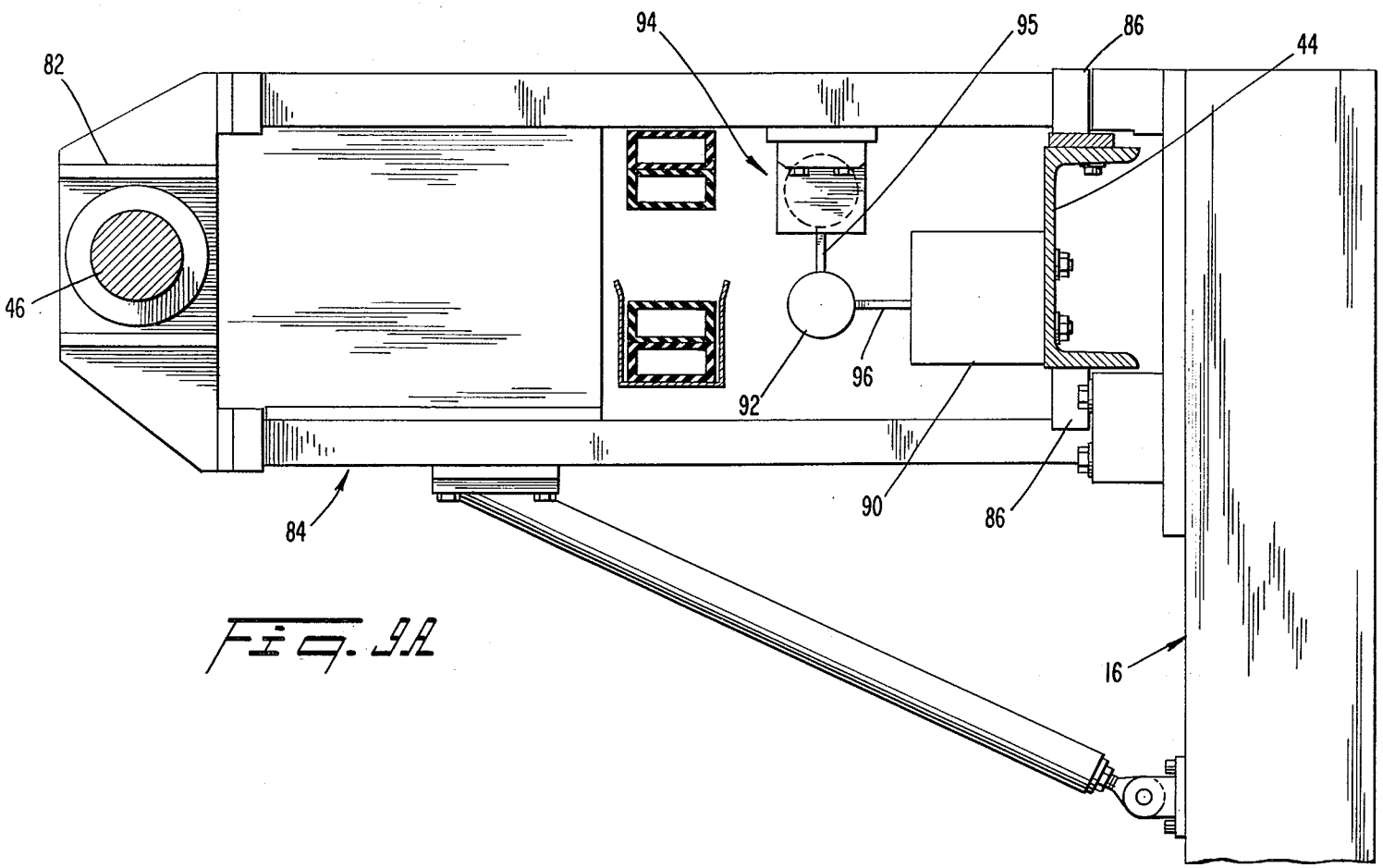
FIG. 9A is a cross-sectional view through the carrier, depicting the manner of mounting the column on the carrier.

The upper end of the column 16 is slidably mounted to the carriage by a pair of guide sleeves 82 (FIG. 16) which are slidably mounted on the rear bar 46 of the carrier. The sleeves are connected to the column 16 by a skeletal support frame 84, portions of which extend above and below the front cross bar 44 of the carriage 12. The support frame 84 also carries a plurality of rollers 86 positioned above and below the front bar 44 to stabilize the column during its travel (FIG. 9A).

The column is movable along the carriage by any suitable means, but preferably by a series of pneumatic cylinders which afford highly controllable travel speed of the column. There are preferably three double-acting hydraulic cylinders 90, 92, 94 (FIGS. 9A, 16) interconnected in series. The first cylinder 90 has its body connected to the front bar 44 of the carriage. The piston of the first cylinder 90 is connected to a laterally projecting flange 96. The rod end of the second ram 92 is connected to that flange 96. The cylinder portion of the second cylinder 92 is connected to the piston of the third cylinder 94 by a flange 95 similar to the flange 96, the third cylinder 94 being disposed over the second cylinder 92. The body portion of the third ram 94 is connected to the support frame 84 attached to the column 16. Thus, movement of the column can be produced by actuation of any or some of the cylinders 90, 92, 94. Longer movements of the column are produced by activating the longer cylinders, i.e., the first and third cylinders 90, 94, and shorter movements are achieved by activating the shorter second cylinder 92.

The column comprises a vertically elongated channel member 100 (FIG. 10) which is generally U-shaped in cross-section and is connected to the support frame 84.

The column carries the vertically spaced upper and lower slides or heads 18, 20 on which are disposed the package exchange arm 22 and the tube exchange arm 24, respectively. The heads 18, 20 are independently vertically movable to shift the exchange arms 22, 24 from a lower position (e.g., FIG. 23B) to an upper position (e.g., FIG. 23A).

The upper head 18 (FIGS. 1 and 10) includes a plate 102 having a guide collar 104 attached to a rear side thereof. The guide collar extends into the channel and is slidably mounted on an upright guide track 106 attached to the channel 100.

The upper plate 102 is connected to a pneumatic cylinder 108 seated upright in the channel. The cylinder 108 is of a rodless type wherein the internal piston 110 is connected to a yoke 111 which, in turn, is connected to the upper plate 102.

The lower head 20 includes a plate 112 (FIG. 1) disposed in the same vertical plane as the upper plate 102. The lower plate has a guide collar (not shown) similar to that at 104 of the upper plate which is slidably mounted on the guide track 106.

A second pneumatic cylinder 114, similar to and standing next to the first cylinder 108, is connected to the second plate 112 by means of a yoke 116. By suitable actuation of the cylinders 108, 114, the package and tube exchange arms 22, 24 can be raised and lowered.

The package exchange arm 22 includes a cylindrically tubular rod 120 and a mounting bracket 122 which mounts the rod 120 to the plate 102 for rotary movement on a vertical pivot pin 124. The pin 124 constitutes the output shaft of a rotary motor, such as a pneumatic rotary motor 125, which is mounted on the upper plate 102. By actuating the motor, the package exchange arm can be rotated 180° between forwardly and rearwardly facing positions (e.g., compare FIGS. 1 and 5). The package exchange rod is hollow and contains a longitudinal slot 126 (FIG. 2) along an upper portion thereof. A plurality of notched bars 128 are disposed on opposite sides of the slot 126. These bars have rearwardly facing teeth which contact the packages P on the rod 120 and frictionally resist egress of the packages from the rod during rotation of the package exchange arm 22.

The tube exchange arm 24 (FIGS. 1, 11, 12) includes a bracket 130 pivotally mounted to the lower plate 112 for rotation about a vertical pin 131. This pin constitutes the output shaft of a pneumatic rotary motor 132. Actuation of the motor produces rotation of the tube exchange arm 24.

Figure 11:
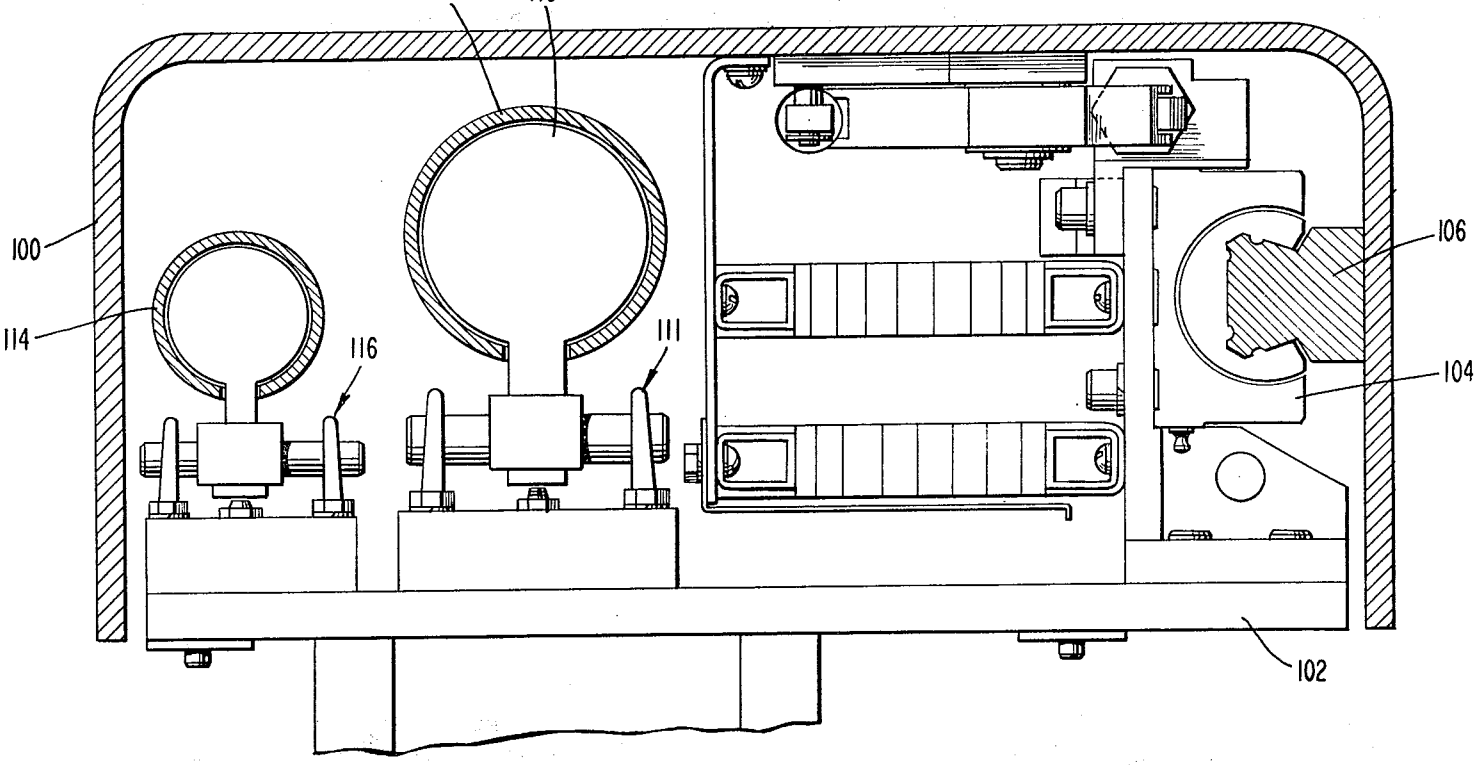
FIG. 11 is a longitudinal sectional view through the tube exchange mechanism, there being no tubes disposed in the tube exchange arm.
Figure 11:
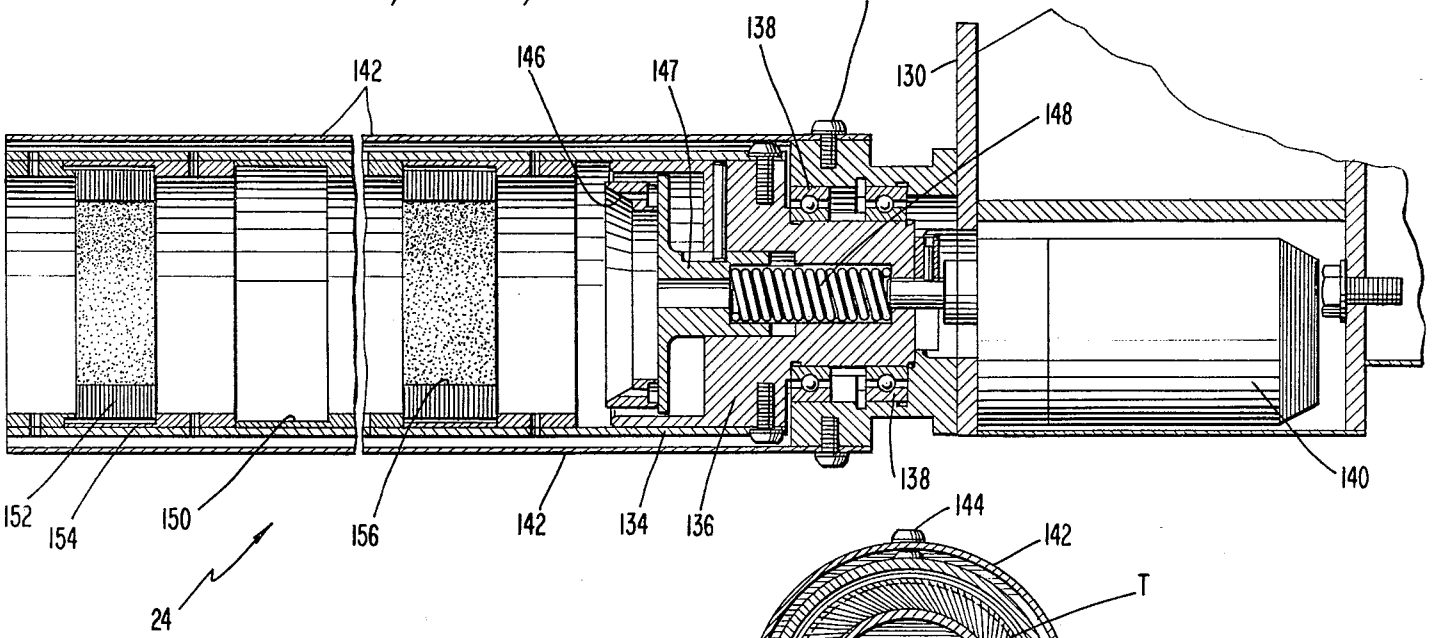
Figure 12:
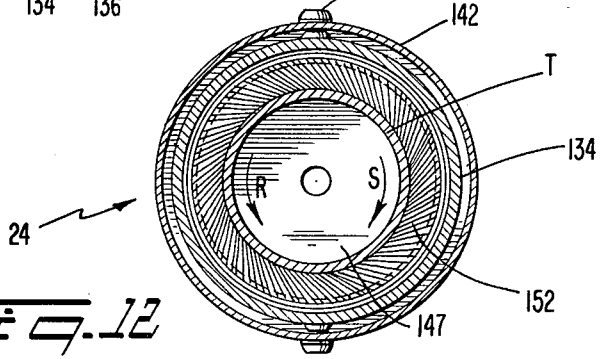
FIG. 12 is a cross-sectional view through the tube exchange arm mechanism, depicting a tube in the tube exchange arm.

The tube exchange arm 24 may assume various forms, depending upon the type of winder employed. In the case of some winders, the tubes T must be inserted onto and removed from the spindle while being rotated about their longitudinal axes in order to properly depress retainers carried by the spindle. In such cases, an advantageous tube exchange arm comprises a hollow cylinder 134 as depicted in FIGS. 11–12. The cylinder 134 includes a journal 136 which is mounted on the bracket 130 by means of bearings 138 carried by the bracket. The journal 136 is connected to a pneumatic rotary motor 140 mounted on the bracket 130. A horizontal output shaft of that motor is connected to the journal 136 to rotate the cylinder 134 about its longitudinal axis. A tubular cover or sheath 142 is disposed around the cylinder 134 and is attached to the bracket 130 by means of screws 144 so as to be held against rotation.

The cylinder carries an inner abutment shoulder in the form of a beveled ring 146. The ring 146 has an end projection 147 which is slidable in a hole in the journal 136 and is biased longitudinally outwardly by a coil compression spring 148.

The cylinder has an inner liner 150 to which are connected a plurality of projections, preferably in the form of wire fingers or bristles 152. These bristles may be mounted in any suitable fashion but preferably comprise a series of axially spaced annular rings of wire brush bristles which are suitably bonded in grooves 154 of the liner. The bristles may be formed of any suitable material such as metal or plastic for example. In a relaxed state, these bristles project radially inwardly. The inner tips 156 of the bristles define a circular area or aperture smaller in diameter than the diameter of the tubes T.

When the cylinder 134 is telescoped over a plurality of aligned tubes T, while being simultaneously rotated relative to the tubes, the inner ends of the bristles 152 are deflected generally tangentially (see FIG. 12) and frictionally grasp the tubes T. The bristles now permit rotation between the tubes and the cylinder 134 in one direction only. That is, relative rotation between the tubes T and cylinder 134 is permissible only in the initial direction of rotation R (FIG. 12) in which the tubes T were first captured. Relative rotation in the opposite direction S is prevented by the inability of the deflected bristles to reverse their direction of deflection. Thus, the tubes are firmly gripped by the bristles during rotation in such opposite direction S.

The beveled stop ring 146 serves to keep the tubes T axially centered within the cylinder as well as to cushion the telescoping convergence of the tubes within the cylinder.

By axially telescoping a tube-carrying cylinder 134 over an empty winder spindle 32, while simultaneously rotating the cylinder in the afore-mentioned opposite direction S (wherein relative rotation between the tubes T and cylinder 134 is prevented), the tubes also rotate and thus are able to depress the conventional yieldable retainers on the winder spindle 32 and thus can pass along the spindle. Once the tubes are in place on the spindle 32, the cylinder 134 is withdrawn axially from the spindle while being rotated in the initial direction R thereby permitting relative rotation between the tubes T and the cylinder 134, and a resultant loosening of the grip of the bristles 152 on the tubes T. Accordingly, the tubes T remain seated on the winder spindle 32 when the cylinder is withdrawn.

An important benefit derived from the flexible bristles 152 is the compliance which is accorded the tubes T within the cylinder 134. Thus, there need not occur precise alignment between the cylinder 134 and the spindle 32, since the bristles 152 can flex to accommodate limited amounts of radial or axial misalignment.

In cases where it is possible for the tubes to be inserted onto the winder spindle 32 without being simultaneously rotated, the rotary cylinder 134 could be replaced by a different arrangement, such as a rigid rod which is to be aligned with the winder spindle, and a pusher mechanism of some sort for pushing tubes from the rod and onto the spindle.

Figure 13:
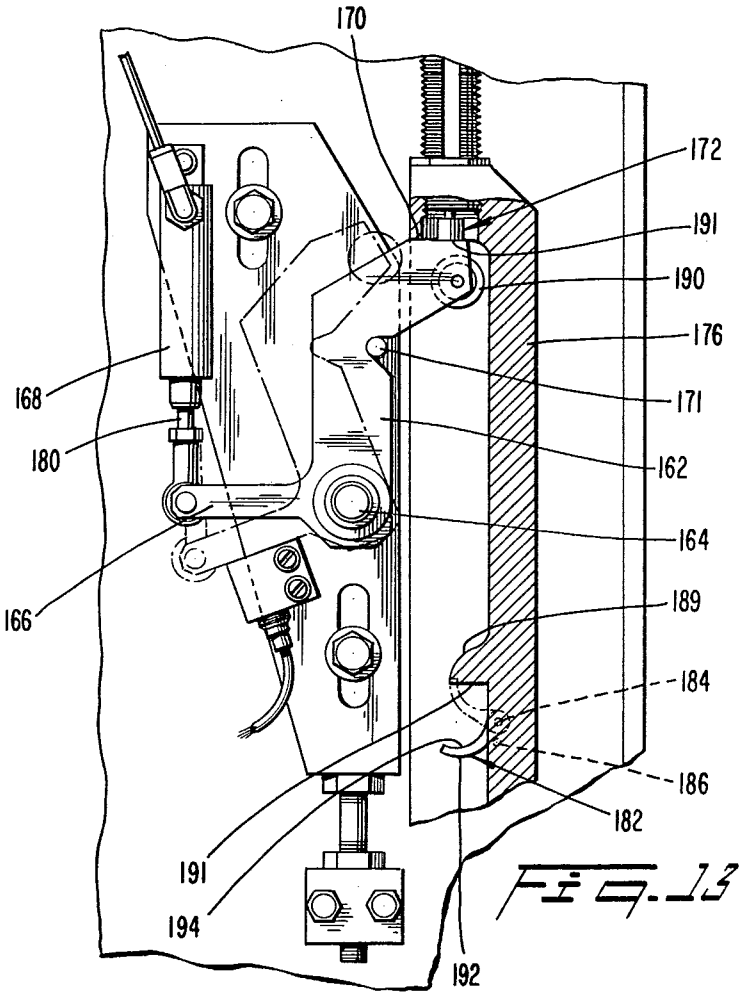
FIG. 13 is an enlarged view of an upper stop on the column, with a portion of the tube exchange mechanism broken away, depicting the condition wherein the tube exchange mechanism abuts the stop in order to position the package exchange arm in alignment with the winder spindles.

In order to orient and retain the package exchange arm 22 and the tube exchange arm 24 in longitudinal alignment with a winder spindle 32, a positioning mechanism 160 (FIGS. 6, 13 and 14) is provided. That positioning mechanism comprises a stop arm 162 rotatably mounted to the channel 100 by a pin 164. A crank arm 166 projects from the stop arm and is connected to a single-acting, spring-return pneumatic cylinder 168 which rotates the stop arm (and a stop surface 170 thereon) between a retracted position (broken lines in FIG. 13) and a stop position (solid lines in FIG. 13). A fixed limit pin 171 is engaged by the stop member in the latter's stop position. In its stop position, the stop surface 170 limits downward motion of the lower head 20 by engaging an adjustable stop/limit switch 172 connected to the plate 112 of the lower head 20 (FIG. 13). When this engagement occurs, the lower head 20 is properly positioned to act as a stop for the upper head. That is, upon subsequent descent of the upper head 18, the lower edge of the upper plate 102 contacts and seats upon the upper edge of the lower plate 112.

The stop 172 is mounted on an upright post 176 of the lower head 20 which is disposed behind the common plane defined by the plates 102, 112, and is oriented to contact the stop surface 170 when the stop arm 162 is in its stop position. The stop arm is biased toward its stop position by the ram 168. As noted earlier, this cylinder is of the single-acting spring-return variety, wherein the rod 180 thereof is yieldably urged to a retracted position by means of an internal spring, but the rod can be forcefully extended by fluid pressure to swing the stop arm to its retracted or out-of-the-way position.

Figure 3:
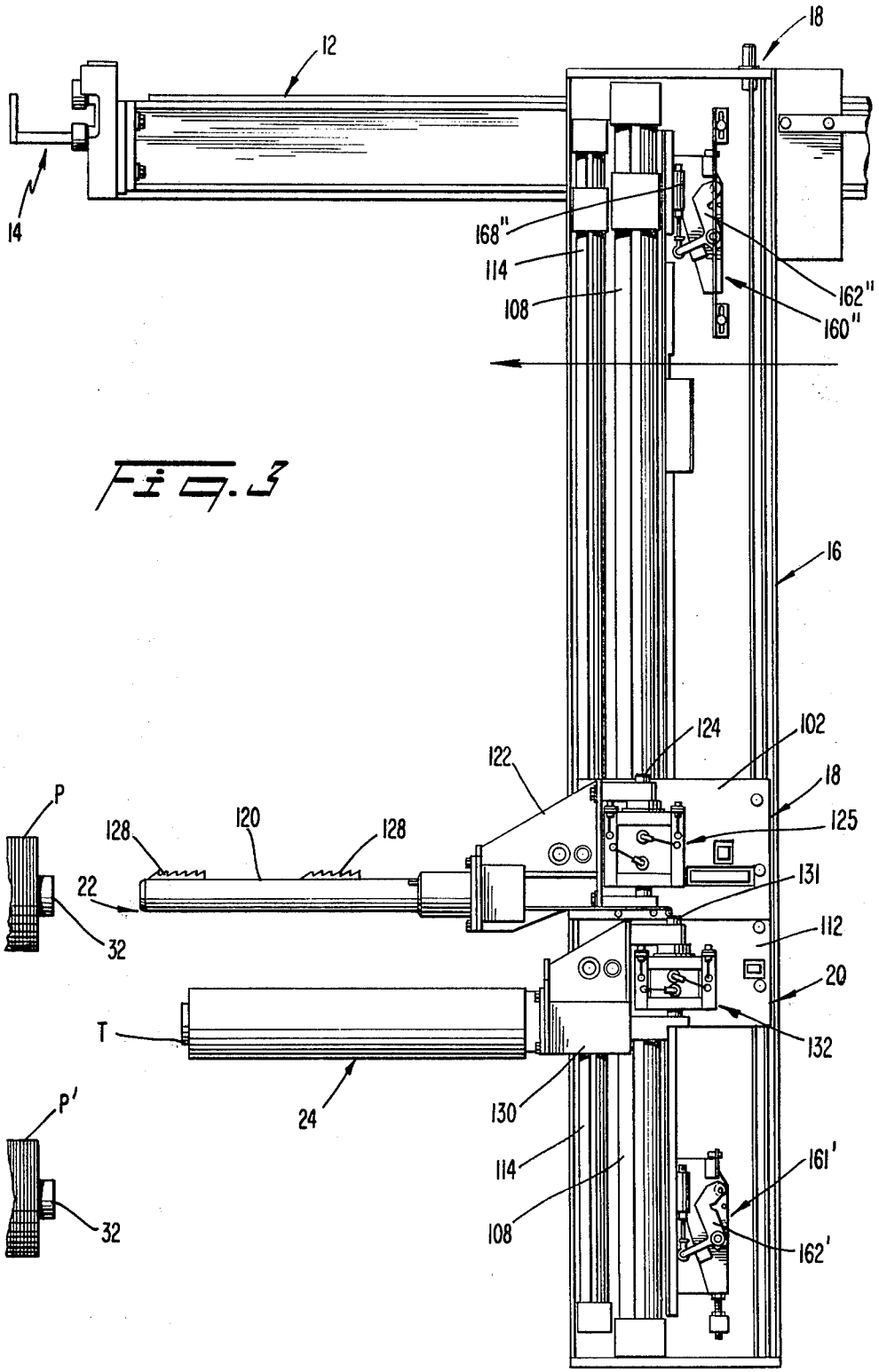
FIG. 3 is a view similar to FIG. 1, with the package exchange arm and the tube exchange arm disposed in a first operable position, with the package exchange arm aligned with a spindle of a winder to be serviced.

The post 176 includes a swingable locator arm 182 which is freely rotatable about a horizontal pivot pin 184 and rests against a stop pin 186. The locator arm 182 is situated beneath a cam surface 180 and can be swung upwardly such that the free end of the locator arm enters a slit in the cam surface 189. The slit is narrower than the length of a roller 190 which is freely rotatably mounted at the end of the stop arm 162. As the post 176 travels downwardly with the lower head 20, and with the stop arm 162 in its stop position (solid lines), the lower surface 192 of the locator arm 182 contacts the roller 190 from above and is swung upwardly by the latter to its upper limit (the broken line position in FIG. 13). At that point, the bottom surface 192 of the locator arm functions as a cam surface to swing the stop arm 162 toward its retracted position, allowing the lower head 20 to further descend, until the stop 172 on the post engages the stop surface 170 of the stop arm 162. This defines an intermediate position of the lower head wherein the latter awaits the arrival of the upper head 18. The upper head lands upon the lower head 20 and is supported and positioned thereby, such that the upper head is operable to receive packages from a winder spindle 32 (FIG. 3).

Figure 5:
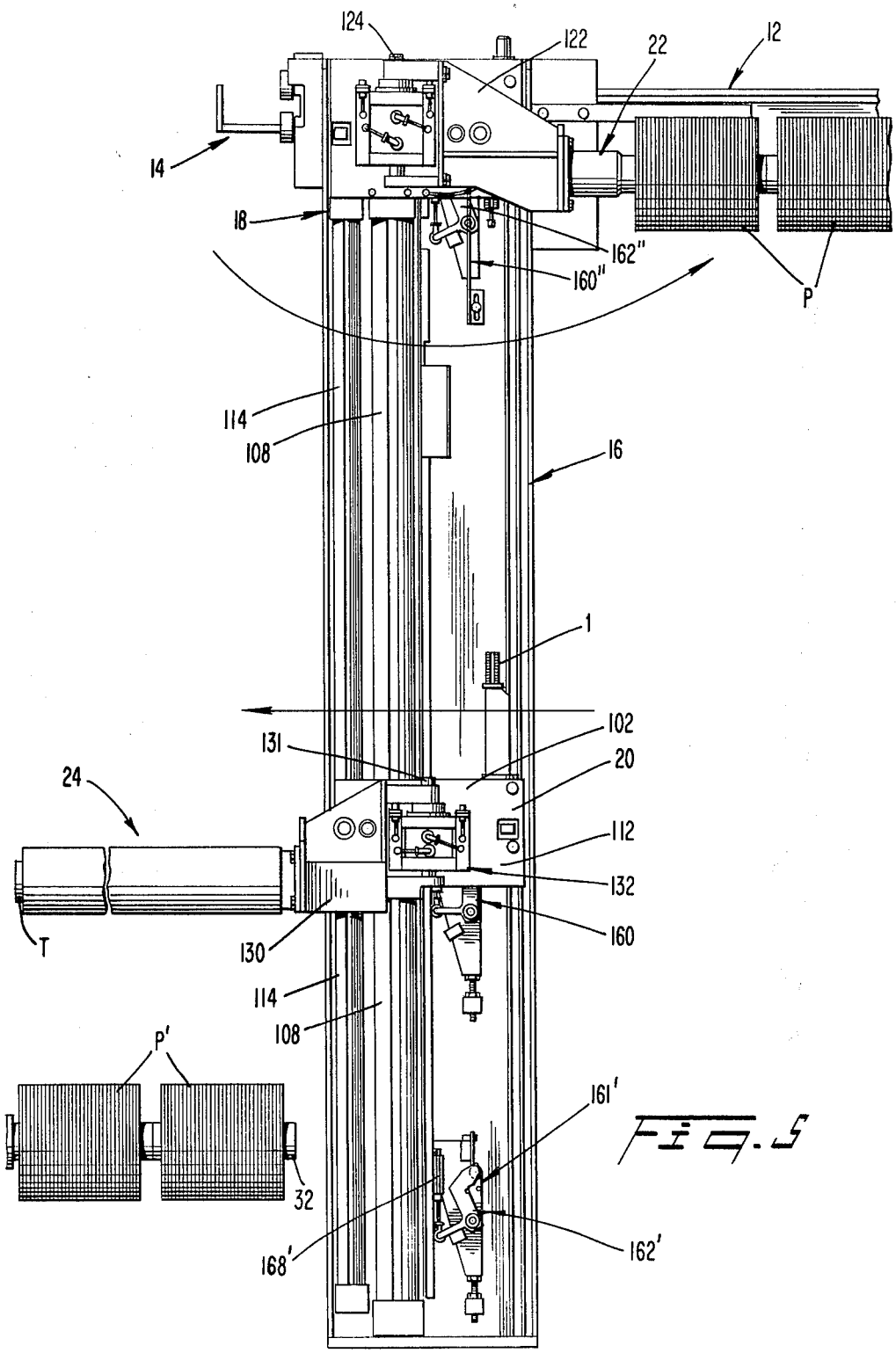
FIG. 5 is a view similar to FIG. 4, after the package exchange arm has been raised and rotated 180°, and the tube exchange arm has been telescoped over the winder spindle in order to deliver new tubes thereto.

After the upper head 18 has received the packages and has ascended to a raised position (FIG. 5), the lower head 20 is raised to a work position such that tubes T can be transferred to the spindle 32 (FIG. 5). During this movement of the lower head 20, the cam surface 180 on the column (FIGS. 13, 14) engages the roller 190 from below and swings the stop arm 162 toward its retracted position, allowing the lower head 20 to continue rising. After the cam surface 189 passes the roller 190, the spring arm 162 (which is spring-biased by the ram 168) swings back to its stop position whereupon the roller 190 is situated over the locator arm 182. Accordingly, the latter engages the roller 190 in a curved pocket 194, and the lower head 20 stops. After a predetermined time delay, the lower head 20 descends slightly until the cam abutment face 191 engages the stop surface 170 (FIG. 15). Thus, the tube exchange arm 24 is aligned with the spindle 32.

In order to permit rising of the lower head 20 after the tubes T have been exchanged, the stop arm 162 is retracted by the ram 168 such that the roller 190 no longer upstructs upward movement of the locator arm 82.

It will be appreciated that when the winder 10 being serviced is of the type having a lower spindle 32' disposed below the upper spindle 32, it is necessary for the upper and lower heads 18, 20 to travel past the stop arm 162 in order to service the lower spindle 32'. This is achieved by actuating the cylinder 168 to retract the stop arm 162 while the heads 18, 20 are descending. The column 16 is provided with another positioning mechanism 160' (FIG. 6) located below the earlier described positioning mechanism 160. The two positioning mechanisms 160, 160' are essentially identical in construction and operation.

A locking mechanism 160" (FIG. 3) is located at the top of the column and is similar in structure and operation to the earlier-described positioning mechanism 160 to lock the upper and lower heads 18, 20 in their upper positions when the column 16 is in transit. That is, the stop arm 162" of the locking mechanism 160" is swung to its stop position underlying the stop 172 of the lower head 20 when the upper and lower heads 18, 20 are in their uppermost positions. This prevents unintended lowering of the heads when the column travels to and from the shuttle.

Figures 6, 8:
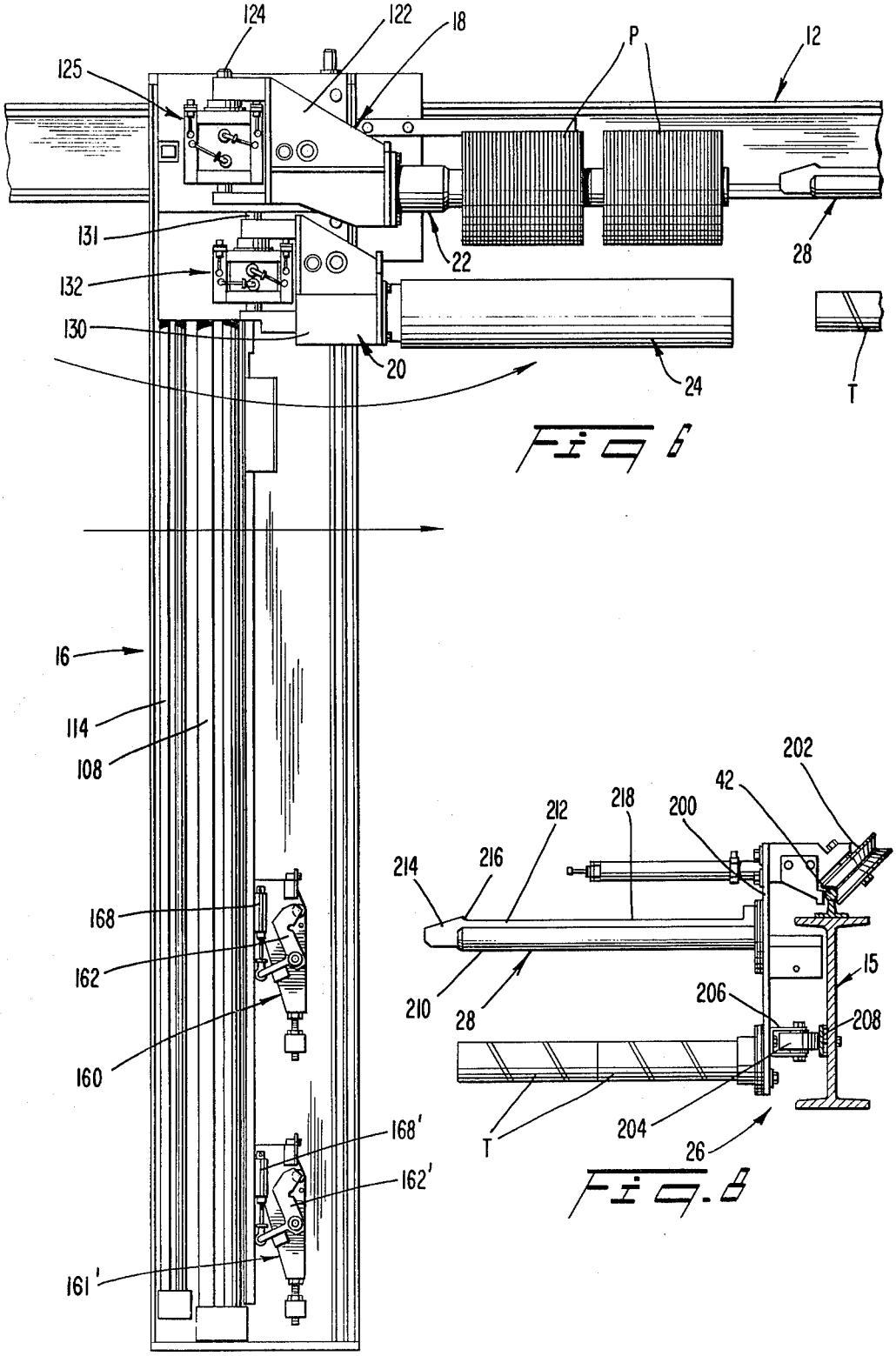
FIG. 6 is a view similar to FIG. 5 after the tube exchange arm has been raised and rotated 180° and the column is approaching the shuttle.
FIG. 8 is a side elevational view of the shuttle as the latter awaits arrival of the column, with the package transfer arm being empty, and the tube transfer arm carrying a pair of tubes.

Thus, after the upper head 18 has received packages from a spindle and the lower head 20 has delivered tubes to that spindle, the upper and lower heads are locked in their uppermost positions, and the column 16 is moved toward the shuttle 26, with the exchange arms 22, 24 facing toward the shuttle (FIG. 6).

Figure 17:
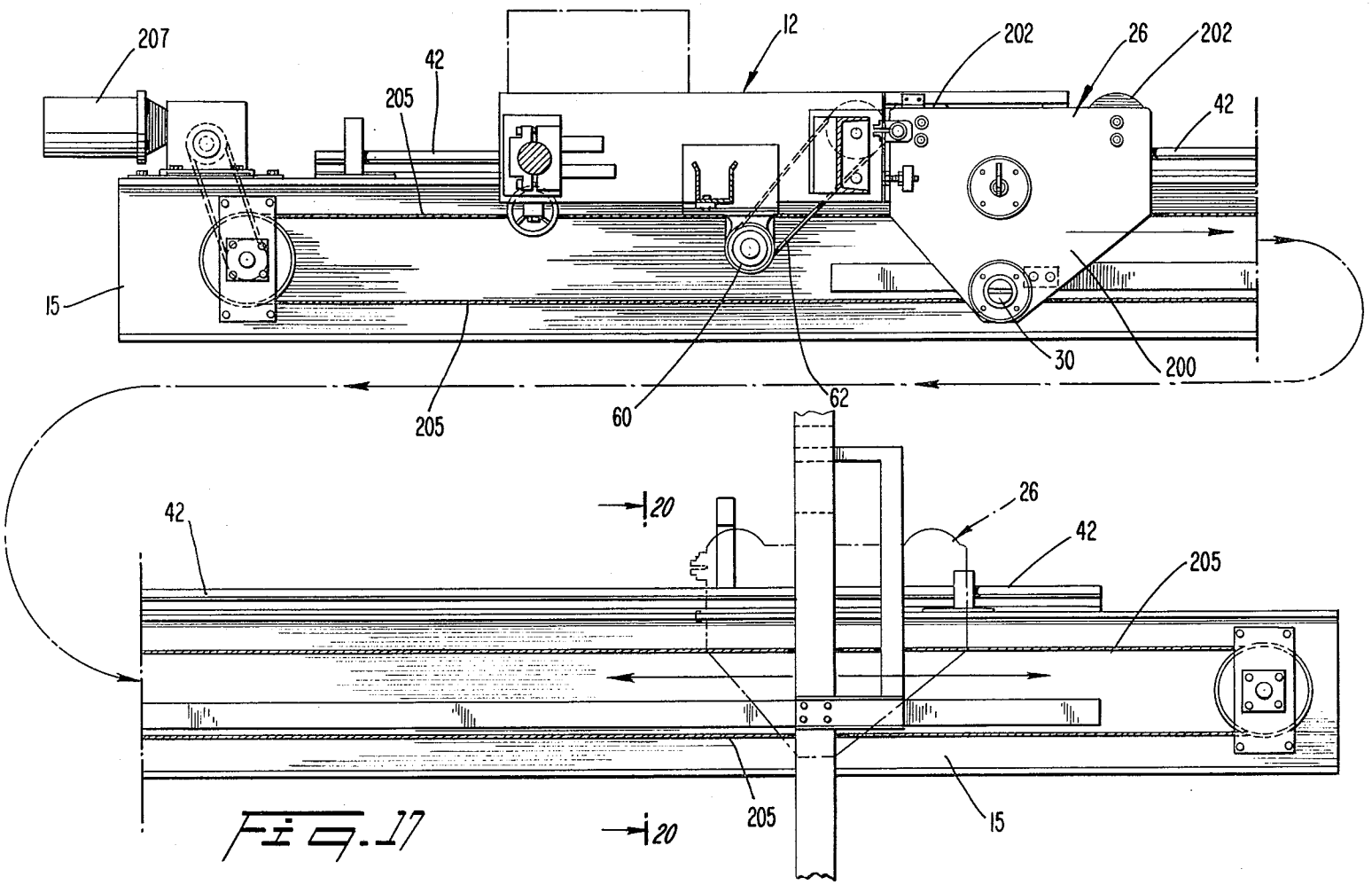
FIG. 17 is an end view of the carrier and shuttle, depicting the shuttle in phantom lines as it travels toward and away from the carrier.
Figure 18:
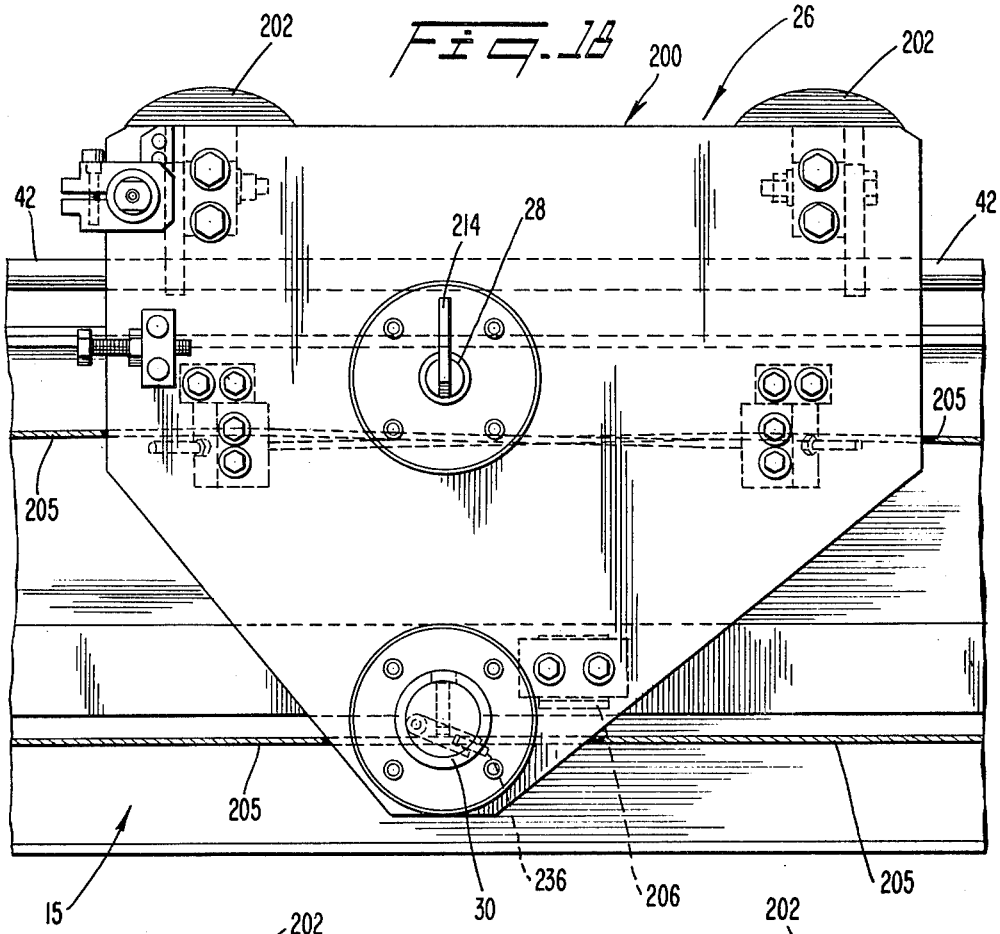
FIG. 18 is an enlarged end view of the shuttle.

The shuttle mechanism 26 comprises a traveling frame 200 (FIGS. 8 and 9) which carries a pair of inclined support wheels 202 having a V-shaped outer periphery. The support wheels 202 ride along the track surface 42. A lower wheel 204 is mounted on a yoke 206 and is rotatable about a vertical axis. This lower wheel 204 bears against an intermediate vertical surface 208 located below the track surface 42. The shuttle 26 is propelled by means of a cable 205 (FIG. 17), the opposite ends of which are connected to the frame 200. A motor 207 drives the cable to transmit linear motion to the shuttle.

The package transfer arm 28 comprises a bar 210 rigidly connected to the frame 200 and projecting at right angles therefrom and parallel to the axes of the winder spindles 32. Extending longitudinally along an upper portion of the bar 210 is a package elevating plate 212 which includes a forwardly and downwardly inclined front cam surface 214 and an oppositely inclined shoulder 216 therebehind.

The bar 210, 212 is sized to telescopingly enter the tubular package exchange arm 120 when the latter approaches the shuttle 126. Such telescoping occurs such that the elevating plate 212 projects through the slot 126 as the bar enters a package-laden arm 120, whereby the inclined cam surface 214 successively engages the packages P, camming them upwardly. Eventually, the cam plate raises both of the packages P, whereupon the packages P become seated on a support surface 218 of the plate 212, with longitudinal egress of the packages P being resisted by the stop shoulder 216. Hence, upon separation of the package exchange arm 120 and the bar 210, the packages P remain seated on the surface 218 (FIG. 9).

Projecting from the shuttle frame 200 beneath the package transfer arm 28 is the tube transfer arm 30 (FIG. 9) which is sized to telescopingly enter the cylinder 134 of the tube exchange arm 24 when the latter approaches the shuttle 126. This is achieved while simultaneously rotating the cylinder 134 about its longitudinal axis in direction R (FIG. 12) so that tubes T carried by the tube transfer arm 30 become captured by the tube exchange cylinder 134 and remain therewith when the cylinder 134 separates from the transfer arm 30.

In order that the cylinder 134 is caused to rotate relative to the tubes, the tubes are gripped on the tube transfer arm 30 by means of a tube locking mechanism. In this regard, the tube transfer arm 30 comprises a rod 232 (FIG. 22) which contains a series of radially open pockets 234 therein. Within each pocket is mounted a roller 236. Each roller is journaled at the free end of a yoke 238 which is freely pivotably mounted by a pivot pin 240. The pin 240 is mounted in an element 242 which is insertable into the pocket 234. Thus, the element 242, yoke 238, roller 236, and pin 240 form part of a unit which can be inserted into the pocket 234 and secured to the rod 232 by means of screws 244 disposed on opposite sides of the yoke 238.

The yoke is swingable between first and second limits, an outer limit of which being defined by a surface 250 on the element 242, and an inner limit of which defined by a surface 252 on the rod. Since the swinging axis of the yoke is spaced from the center axis of the rod 232, the roller 236 projects farther beyond the periphery 254 of the rod 232 at its outer limit (FIG. 22) than at its inner limit.

When the tube exchange cylinder 134 passes onto the rod 232 and the tubes T carried thereby, the cylinder 134 is simultaneously rotated by the motor 140 as noted earlier. This rotation is in a direction such that any tendency of the tubes to rotate causes the locking rollers to move to the outer limit and resist tube rotation. As the cylinder 134 thus rotates relative to the tubes T, the bristles 156 are deflected in the manner depicted and described in connection with FIG. 12. To withdraw the tubes, the cylinder 134 is rotated in the opposite direction S to lock onto the tubes and withdraw same when the cylinder 134 is withdrawn. Resistance to tube withdrawal from the rod 232 is minimal, due to the freely rotatable nature of the rollers 236.

Figure 20:
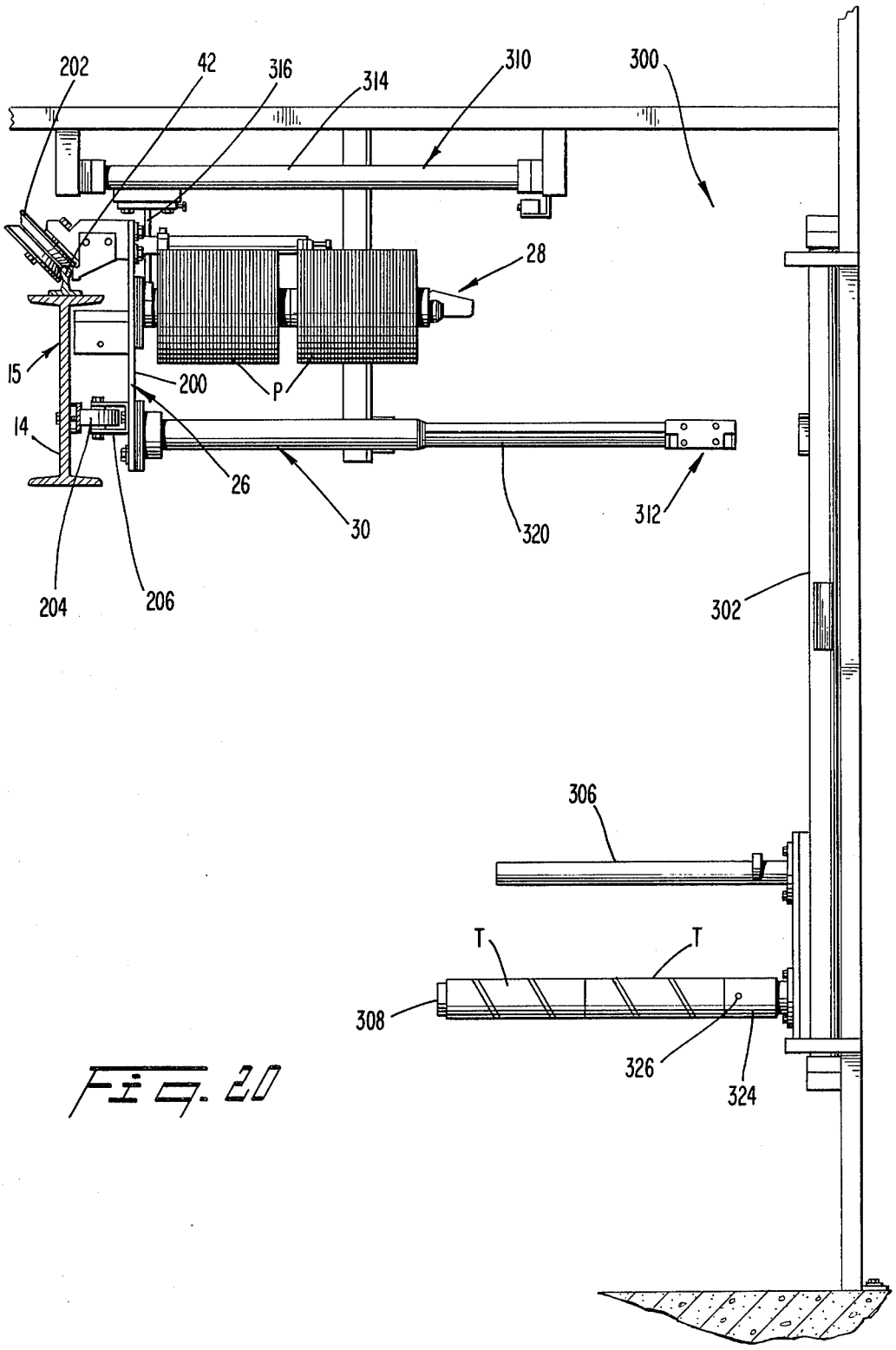
FIG. 20 is a side elevational view of the shuttle disposed at the shuttle servicing station, with the package transfer arm of the shuttle bearing two packages, and with a package removal arm of a shuttle servicing mechanism being empty, and a tube supply arm carrying a pair of tubes.
Figures 21, 22:
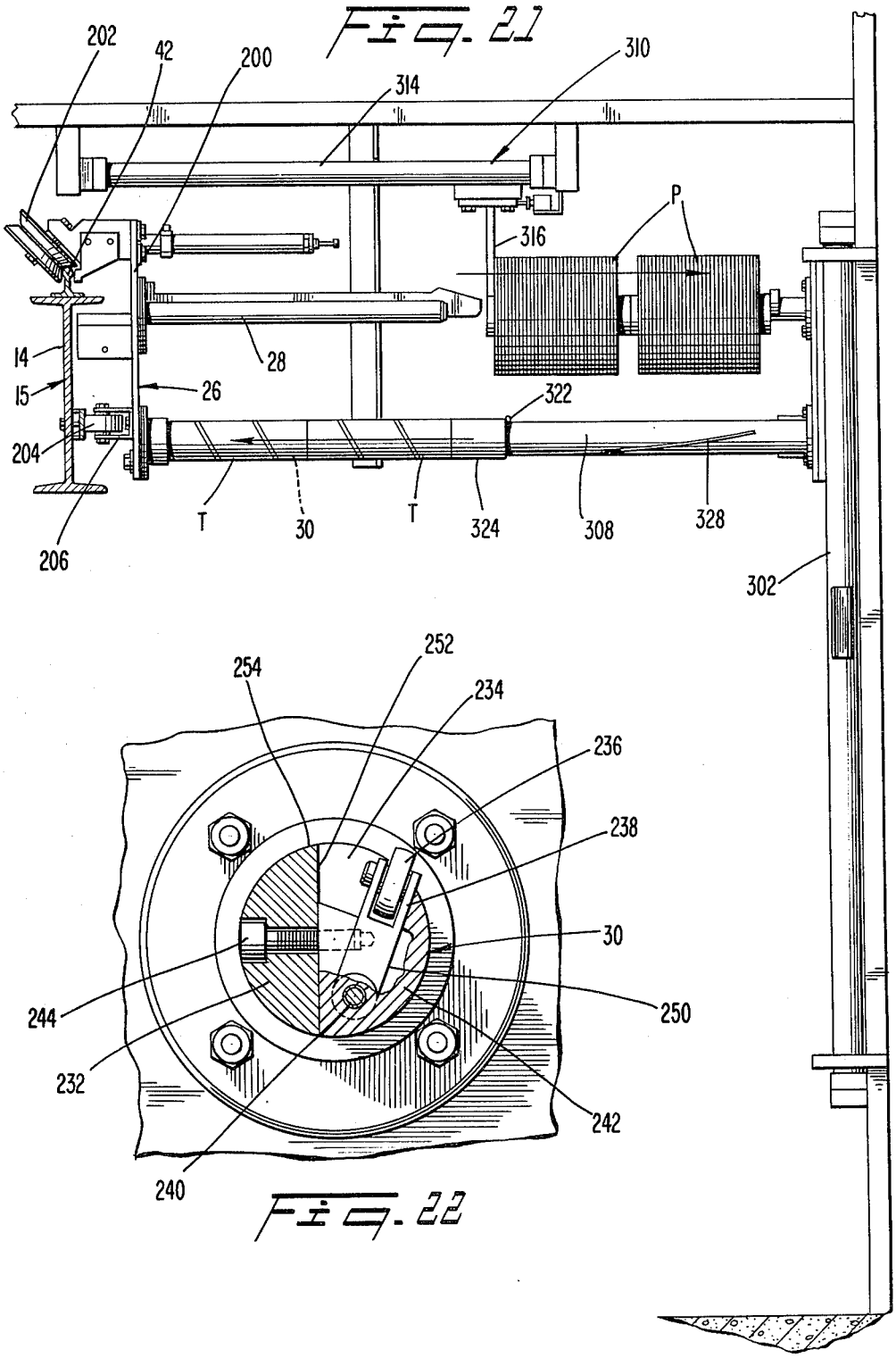
FIG. 21 is a view similar to FIG. 20, after the packages have been transferred from the package transfer arm to the package removal arm, and the tubes have been transferred from the tube supply arm to the tube transfer arm of the shuttle.
FIG. 22 is a cross-sectional view through the shuttle tube transfer arm, depicting a braking wheel thereof at its outer limit.

Once the tubes have been transferred from the transfer arm 30 to the tube exchange arm 24, and the packages P have been transferred from the package exchange arm 22 to the package transfer arm 28, the shuttle travels to a shuttle servicing station 300 (FIGS. 20, 21).

The servicing station 300 includes a frame 302 on which is vertically slidable a platen 304. The platen 304 carries a horizontal package removal arm 306 and a horizontal tube supply arm 308. The vertical spacing between the two arms 306, 308 corresponds to the spacing between the package transfer arm 28 and the tube transfer arm 30 of the shuttle. Thus, the platen 304 can be raised to align the package transfer arm 28 with the package removal arm 306, and to align the tube transfer arm 30 with the tube supply arm 308 (FIG. 21).

The platen 304 is connected to a pneumatic cylinder (not shown) mounted in the frame 302, which cylinder effects vertical movement of the platen.

Disposed atop the frame 302 is a package displacement mechanism 310 for transferring packages from the package transfer arm 22 to the package removal arm 306, and a tube displacement mechanism 312 for transferring tubes from the tube supply arm 308 to the tube transfer arm 30. The package displacement mechanism 310 comprises a pneumatic cylinder 314 with a laterally extending pusher leg 316. The cylinder 314 is oriented parallel to the package transfer arm 22 and the pusher leg 316 is arranged to travel closely adjacent the package transfer arm. The pusher leg 316 is normally disposed to lie behind any packages P situated on the package transfer arm as illustrated in FIG. 20 so that actuation of the cylinder 314 causes the packages P to be pushed from the package transfer arm 28 and onto the package removal arm 306 (FIG. 21).

The tube displacement mechanism comprises a cylinder 320 having a laterally extending tube pusher finger 322. The latter is arranged to extend behind a sleeve 324 which is slidably mounted on the tube supply arm 308, when the latter has been raised into alignment with the tube transfer arm 30. The sleeve 324 has a pin 326 which projects radially inwardly and seats within a helical slot 328 disposed in the outer wall of the tube supply arm 308. When the tube displacement cylinder 320 is actuated, the finger 322 pushes the sleeve longitudinally along the tube supply arm 308 whereby tubes T located ahead of the sleeve 324 are pushed from the supply arm 308 and onto the tube transfer arm 28 (FIG. 21). This occurs simultaneously with the actuation of the package displacement cylinder 314. As the sleeve 324 travels, the pin 326 rides in the helical slot 328, causing the sleeve to rotate. Rotation of the sleeve is transmitted to the tubes T whereby the sleeves rotate in a direction tending to shift the tube locking rollers 236 (FIG. 22) to their inner limit whereby insertion of the tubes onto the tube transfer arm 30 is facilitated.

It will be appreciated that the various movements of the components of the presently disclosed apparatus can be fed into a main computer by means of conventional limit switches which are positioned to be engaged by the moving components.

IN OPERATION, when one or more packages P have been wound upon the spindle 32 of a winder 10 and are ready to be removed, the filament(s) is severed and aspirated to waste (see for example, the procedure described in copending, commonly assigned U.S. Ser. No. 258,309 filed Apr. 28, 1981, the disclosure of which is incorporated herein by reference). The fact that the packages are ready to be removed can be determined by a main central computer which monitors the period over which winding has occurred. Thus, the computer determines when the packages are to be removed, and signals the carrier drive motor 60 (FIG. 15) to drive the carrier along the tracks 40, 42 toward the winder to be serviced. The sensor 80 (FIG. 16) counts the locator pins 78 which the carrier passes, the counting being monitored by the computer to activate the cylinders 74, 76 (FIG. 16) and displace the fingers 68, 70 against the locator pin 78 which corresponds to the position of the winder to be serviced. As a result, the fingers 68, 70 are moved to their extended positions in contact with the locator pin 78, whereupon the carrier 12 is automatically physically shifted into a position which properly and accurately positions the column 16 relative to the winder to be serviced.

When this has been achieved, the package exchange arm 22 and the tube exchange 24 stand oriented as depicted in FIGS. 1 and 23A. The computer next activates the cylinder 168″ of the locking mechanism 160″ to unlock the upper and lower heads 18, 20. Thereafter, the cylinders 114 and 108 are actuated to lower the upper and lower heads 18, 20 together with the package exchange arm 22 and the tube exchange arm 24. This descent terminates when the stop 172 on the lower head 20 (FIG. 13) engages the stop surface 170 of the stop arm 162. This orientation of the package exchange arm 22 and the tube exchange arm 24 is depicted in FIGS. 3 and 23B. In the event that a lower spindle 32′ on the winder (rather than an upper spindle) is to be serviced, then the stop arm 162 would have been moved to its out-of-the-way position (i.e., the broken line position in FIG. 13), whereupon the slides 18, 20 would have descended until the lower slide engaged the stop arm 162′ of the lowermost positioning mechanism 160′.

Figure 4:
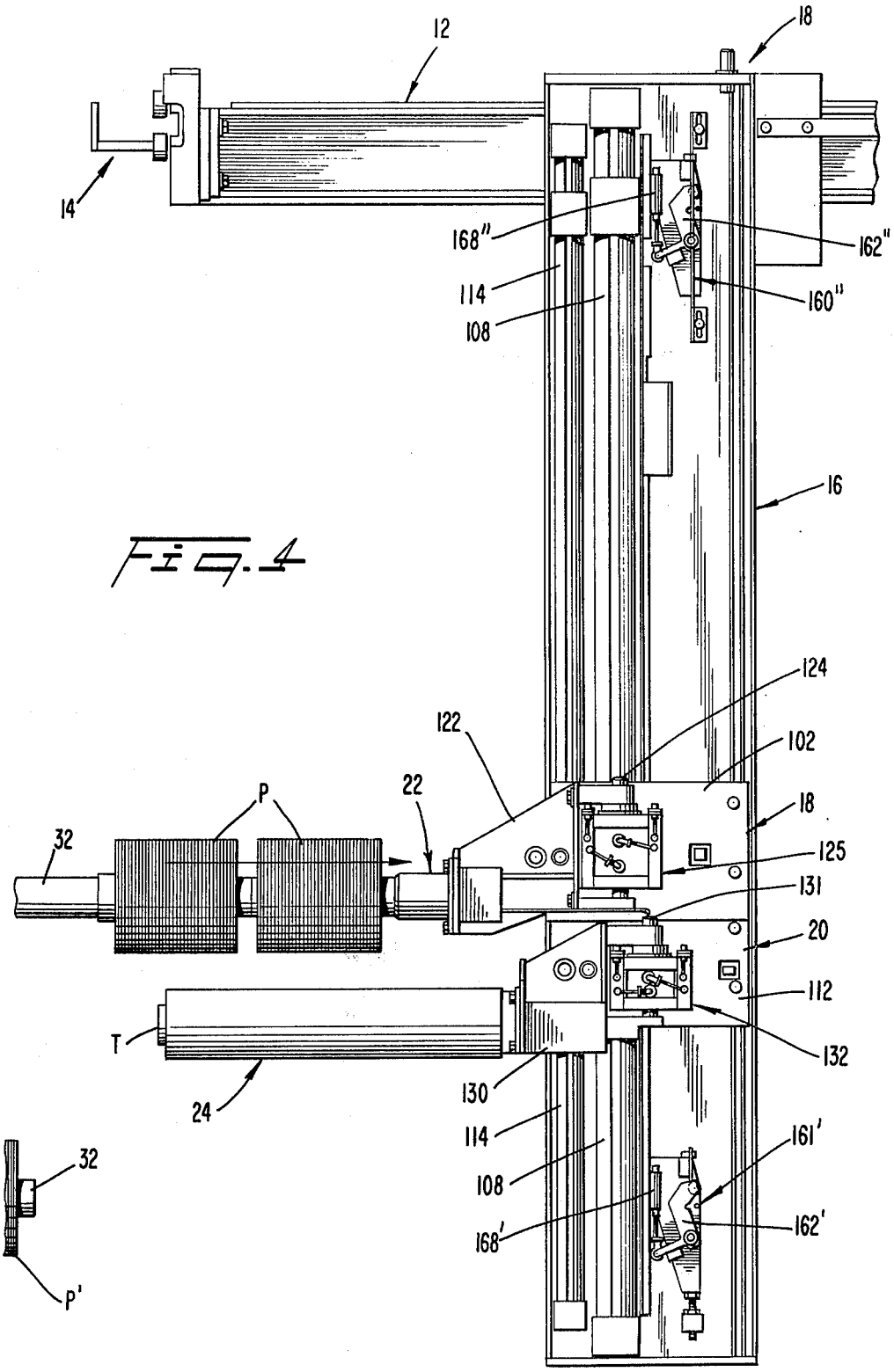
FIG. 4 is a view similar to FIG. 3, after packages have been displaced longitudinally from the spindle onto the package exchange arm.
Figure 14:
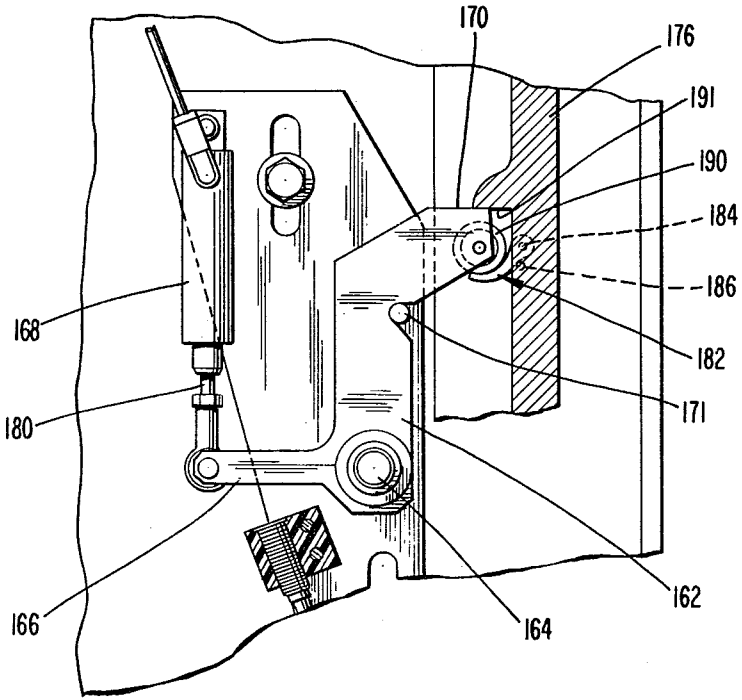
FIG. 14 is a view similar to FIG. 13 depicting the condition wherein the tube exchange mechanism abuts the stop in a manner aligning the tube exchange arm with the winder spindle.

In this position, the package exchange arm 22 is aligned with the spindle 32 of the winder. The computer then actuates the cylinders 90, 92 to advance the column 16 toward the winder to bring the end of the package exchange arm 22 against or nearly against the end of the spindle 32. With this accomplished, the computer activates the conventional package ejector mechanism of the winder, whereupon the packages are pushed longitudinally from the spindle 32 and onto the package exchange arm 22 (FIGS. 4 and 23C). With this accomplished, cylinder 92 is actuated to slightly retract the column 16 from the winder. Then, cylinder 108 is activated to raise the upper head 18 and the packages P to an upper position (FIG. 23D). At the same time, cylinder 114 is activated to raise the lower head 20. Ascent of the lower head 20 continues until the roller 190 of the stop arm 162 swings into the pocket 194 defined by the locator arm 182 to terminate movement of the lower head 20 (FIG. 13). After a predetermined time delay, the cylinder 114 lowers the lower head 20 until the abutment face 191 comes to rest upon the stop surface 170 of the stop arm 162 (FIG. 14).

At this point, cylinders 92, 94 are actuated to advance the column 16 toward the spindle 32 (FIGS. 5 and 23E). Simultaneously, the motor 140 of the tube exchange arm 24 (FIG. 11) is activated to rotate the cylinder 134, together with the tubes T disposed therein (FIG. 12). As the spindle 32 telescopingly enters the rotating tubes T, the tubes continue their rotation in the direction of the arrow S in FIG. 12, under the driving influence of the bristles 152. This enables the tubes T to depress the conventional springbiased detents on the spindle.

Once the tubes have been inserted onto the spindle, the column 16 is retracted by actuation of cylinders 92, 94 while simultaneously rotating the cylinder 134 in the opposite direction R, whereby relative rotation is permitted between the bristles 152 and the tubes T. This enables the cylinder 134 to be backed-off the tubes, leaving the tubes on the spindle 32 (see FIG. 23F).

Then, cylinder 114 is activated to raise the lower head 20 until the latter abuts against the upper head 18. The package exchange arm 22 and the tube exchange arm 24 are rotated by 180° to a position facing away from the winder 10 (FIGS. 6 and 23G). The package exchange arm 22 must be rotated immediately after ascending, i.e., prior to insertion of the tubes onto the spindle, if the column advance towards the winder is used to push the tubes onto the spindle. This is to eliminate possibility of collision of the tube exchange arm with the structure of the machine above the winders. This rotation is effected by the rotary motors 125, 132 disposed on the upper and lower heads 18, 20, respectively.

Figure 16:
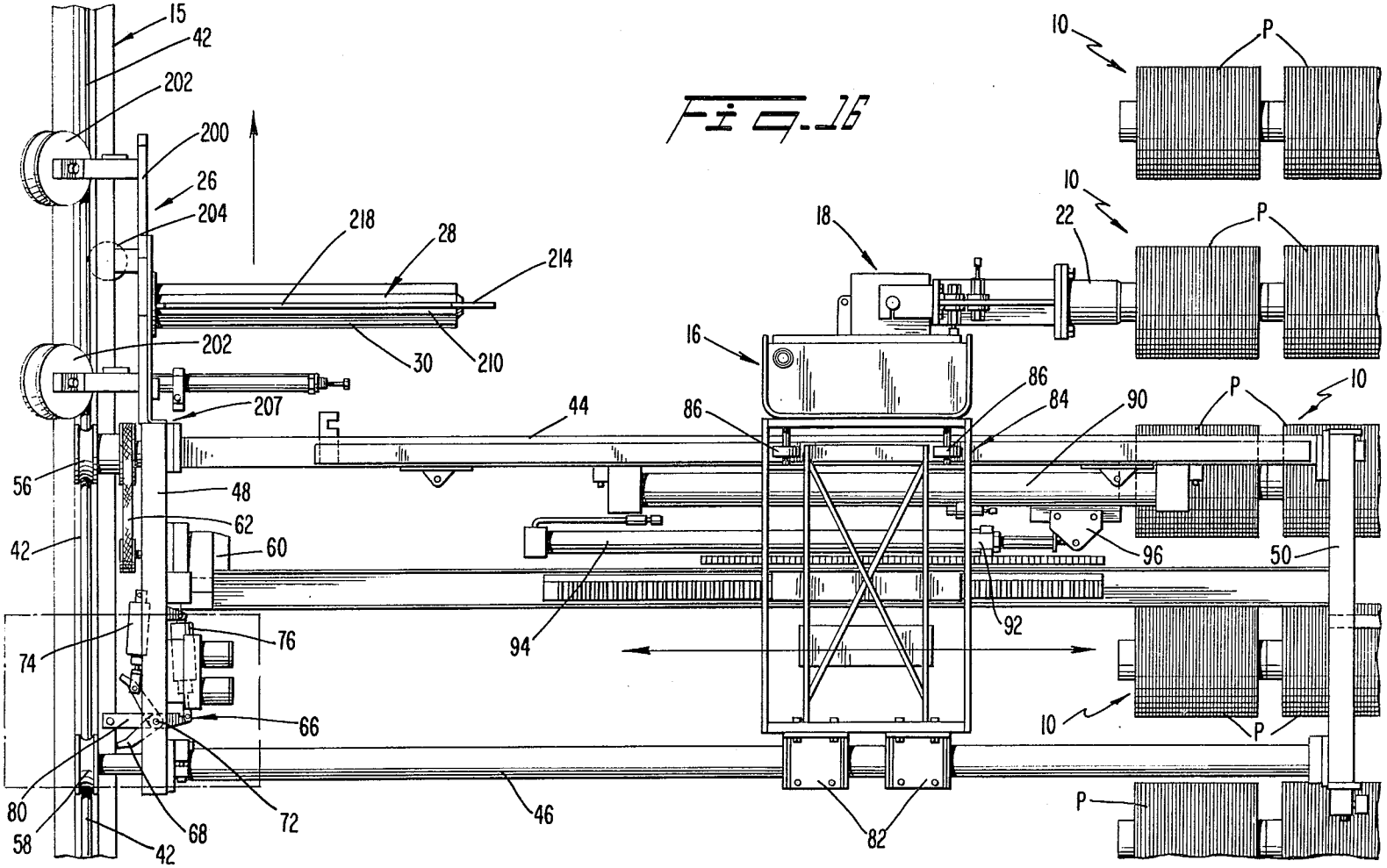
FIG. 16 is a plan view of the apparatus according to the invention.

During the foregoing operation, the shuttle 26 has been signaled by the computer to travel to a location suitable for servicing the upper and lower heads. That is, the shuttle approaches the carrier until contact is made with the carrier at 207 (FIG. 16). The cylinders 90 and 94 are actuated to displace the column 16 toward the shuttle, with the package and tube exchange arms 20, 24 disposed in alignment with the package and tube transfer arms 28, 30, respectively. The tube transfer arm 30 carries a set of empty tubes T which have been received from the supply station 300.

Figure 19:
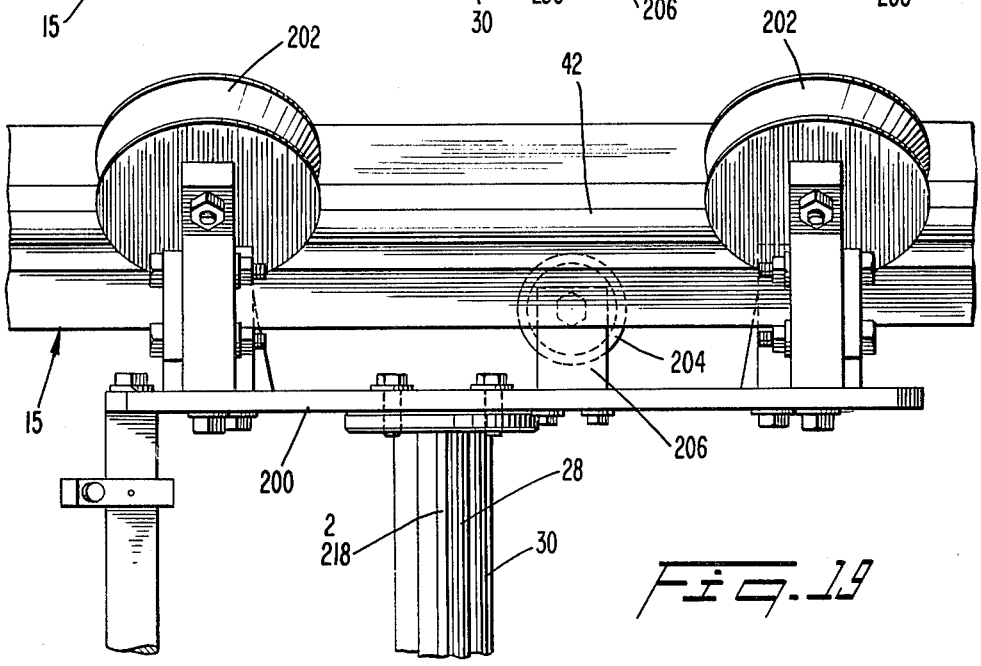
FIG. 19 is an enlarged plan view of the shuttle.

As the column 16 continues to approach the shuttle 26, the package transfer arm 28 telescopingly enters the package exchange arm 22, whereupon the packages P are elevated onto the elevator plate 212 of the package transfer arm 28. Simultaneously, the cylinder 134 of the tube exchange arm 24 telescopes over the tubes T on the tube transfer arm 30 (FIGS. 7 and 23H). As this occurs, the cylinder 134 is rotated in the direction R in FIG. 19, whereupon the bristles 152 become slanted in the manner depicted in FIG. 12 and the cylinder 134 and bristles 152 slide smoothly longitudinally along the tubes T. Rotation of the tubes T is resisted by the action of the locking rollers 236 (FIG. 22).

Thereafter, the column 16 is displaced away from the shuttle, whereupon the packages P remain seated on the package transfer arm 28. Simultaneously, the tube 134 is rotated in the direction S in FIG. 19, whereupon the tubes T are constrained to rotate therewith. This causes the locking rollers 234 to be swung to their inward limit against the surface 252, enabling the tubes to remain in the cylinder as the latter is pulled from the tube transfer arm (FIG. 23F).

The column 16 is now in condition for servicing another winder spindle, in response to an appropriate signal from the main computer.

The shuttle 26, meanwhile, is advanced in response to a suitable signal by the computer toward the shuttle servicing station 300 (FIG. 20). The tube supply arm 308 of the latter has, by this time, been supplied, either manually or mechanically, with empty tubes T, and the package removal arm 306 stands empty and ready to receive packages. Either before or after arrival of the shuttle at the shuttle servicing station 300, the plate 304 is raised so that the package removal arm 306 will be aligned with the package transfer arm 28 and the tube supply arm 308 will be aligned with the tube transfer arm 30 (see FIG. 21). Upon simultaneous actuation of the package displacing leg 316 and the tube displacing finger 322, the packages P are transferred onto the package removal arm 306 and the tubes T are transferred to the tube transfer arm 28. Thus, the shuttle stands ready for servicing the column, after the latter has serviced the next winder spindle.

It will be appreciated that the winder servicing mechanism according to the present invention creates minimal obstruction in the area of the winder. The carrier 12 travels at a level above the height of service and maintenance personnel working in the area and does not interfere with their travel. The column 16 is relatively narrow and only blocks the winder being serviced.

The winders themselves can be located at the usual accessible level, there being no need to elevate the winders to accommodate either the carrier or the shuttle as in the cases earlier described where the conveyor and transfer units are diposed beneath the winders. Thus, there is presented no obstruction or inconvenience to maintenance personnel.

It is also possible to retrofit the winder servicing mechanism to an existing row of winders, since the location of the winders themselves need not be disturbed. This retrofit possibility applies to winders having vertically spaced spindles since the servicing mechanism can service vertically spaced spindles.

The package exchange arm 24 according to the present invention is highly advantageous in that it eliminates the need for precision alignment with the spindle. That is, the gripping engagement between the cylinder 134 and the tubes is achieved by the bristles 152 of the arm 24, which bristles are flexible and can compensate for slight misalignments between the arm and the spindle. It will also be appreciated that the tube exchange arm 24 has utility in applications other than that described in connection with the present invention. That is, the arm 24 may function to pick-up and deliver any type or size of objects in accordance with the principles disclosed herein. Thus, any robot intended to grip and/or discharge an object may be provided with a mechanism operating under the principles of the present invention.

Although the preferred embodiment of the present invention involves a rotation of the package/tube exchange arms by 180°, it is possible that a lesser rotation, e.g., 90°, could be provided. In such an event, the package/tube transfer arms would be oriented parallel to the row of winders, rather than perpendicular thereto as depicted in the accompanying drawings. Thus, the exchange and transfer arms would be mated in response to convergence of those arms in a direction parallel to the row of winders.

In addition, the shuttle could be located closer to the column, e.g., positioned in the same vertical plane as the column. This would be particularly convenient in cases where the available space for the carrier and shuttle is limited.

Although the disclosed preferred embodiment has been described in connection with only a single row of winders being serviced by the carrier/column, it would be possible to locate the carrier/column intermediate a pair of opposing rows of winders (e.g., providing an additional row of winders beneath the shuttle). Both rows of winders could be serviced by the tube/package exchange arms on the column. Alternatively, in such a case the shuttle could be oriented as earlier discussed wherein the exchange and transport arms are oriented parallel to the rows of winders, the shuttle disposed midway between the two rows.

Although the present invention has been described in connection with a preferred embodiment thereof, it will be appreciated by those skilled in the art that additions, modifications, substitutions, and deletions not specifically described, may be made without departing from the spirit and scope of the invention as defined in the appended claims.

What is claimed is:

1. Apparatus in combination with a row of winders each of which winds filamentary material upon a tube supported for rotation about a rotary axis of the winder to form a package, said apparatus servicing each winder by removing a package from the winder and replacing the package with a tube and comprising:

a carrier suspended from above the row of winders for movement generally parallel to the row of winders, means for positioning said carrier selectively at locations for servicing respective winders, package exchange means including an arm mounted on said carrier for up-and-down movement and being positionable opposite the rotary axis of a winder being serviced so that the package can be transferred from the winder to the package exchange arm, tube exchange means including an arm mounted on said carrier for up-and-down movement and being positionable opposite said axis so that a tube on the tube exchange arm can be transferred to the winder, shuttle means spaced above the row of winders, and including a package transfer arm and a tube transfer arm, means vertically moving said package exchange means and said tube exchange means to the general level of said shuttle means, means for effecting transfer of the package from the package exchange arm to the package transfer arm and for effecting transfer of a tube from said tube transfer arm to said tube exchange arm, and means for propelling said shuttle means to a remote station where the package is removed from said package transfer arm and a tube is installed on said tube transfer arm.

2. Apparatus according to claim 1 including track means disposed above said row of winders, said carrier being mounted on said track means for movement at least seven feet above a floor on which the winders are supported.

3. Apparatus according to claim 1, wherein said track means comprises a pair of horizontally spaced parallel tracks, one track disposed proximate said row of winders, and the other track disposed remotely thereof, said carrier being mounted on both said tracks.

4. Apparatus according to claim 1, wherein said shuttle means is mounted for movement on said remote track.

5. Apparatus according to claim 1 including a column mounted on said carrier for movement toward and away from the row of winders, said package exchange means and said tube exchange means being mounted for vertical movement on said column, said shuttle means being spaced vertically and horizontally from the row of winders.

6. Apparatus according to claim 5, wherein said package exchange arm and said tube exchange arm are each mounted for movement between horizontal positions spaced 180° so as to generally face the row of winders in one position and the shuttle means in the other position.

7. Apparatus according to claim 6, wherein the package exchange arm and the tube exchange arm are each mounted for pivotal movement about a vertical axis, and motor means for pivoting said package exchange arm and said tube exchange arm thereabout.

8. Apparatus according to claim 7 including positioning means on said column for locating said package exchange means and said tube exchange means in positions opposite the winder spindle.

9. Apparatus according to claim 8, wherein said winder has vertically spaced upper and lower spindles, said positioning means being retractible to enable said package exchange means and said tube exchange means to travel downwardly therebeyond to service the lower spindle.

10. Apparatus according to claim 1, wherein said package exchange means is vertically movable relative to said tube exchange means.

11. Apparatus according to claim 1, wherein said tube exchange arm comprises a cylinder having a hollow bore mounted for rotation about its longitudinal axis, said bore of said cylinder being sized greater than the tube diameter, a plurality of resiliently flexible projections extending inwardly into said bore, inner ends of said projections defining an aperture having a diameter less than the diameter of the tubes, and means for rotating said cylinder about said longitudinal axis as said cylinder is being telescoped over a tube such that inner ends of said projections are flexed generally tangentially in response to engagement with an outer periphery of the tube.

12. Apparatus according to claim 11, wherein said resiliently flexible projections comprise bristles.

13. Apparatus according to claim 11, wherein said tube transfer arm on said shuttle means includes brake means for resisting rotation of a tube thereon when said cylinder is rotated in one direction during longitudinal engagement of said cylinder with said tube transfer arm, said brake means being inoperative during opposite rotation of the cylinder during longitudinal disengagement of said cylinder from said tube transfer arm.

14. Apparatus according to claim 13, wherein said brake means comprises rollers mounted on supports for free rotation about axes disposed generally tangentially relative to the longitudinal axis of said tube transfer arm, said supports each being pivotable about axes spaced from and parallel to said last-named longitudinal axis so as to be movable between first and second limits.

15. Apparatus according to claim 1, wherein said package exchange arm comprises a hollow member onto which the packages are slid, said package transfer arm comprises a rod sized to be received telescopingly in said hollow member, said rod having a package elevating plate projecting upwardly therefrom which enters a longitudinal slot of said hollow member to lift the packages off said hollow member.

16. Apparatus according to claim 1, wherein said elevating plate has an inclined cam plate at its front end to facilitate lifting the packages.

17. Apparatus according to claim 2, wherein said positioning means comprises a plurality of sensible elements on said track means, each said element corresponding to a winder position, and sensing means on said carrier for sensing each said element, so that the location of the carrier can be monitored.

18. Apparatus according to claim 2, wherein said positioning means comprises a plurality of stationary elements on said track means, means mounted on said carrier for movement into engagement with a selected said element to locate said carrier relative thereto.

19. Apparatus according to claim 18, wherein said last-named means comprises a pair of fingers movable into contact with opposite sides of each element, and motor means for moving said fingers.

20. Apparatus according to claim 1, wherein said transfer effecting means comprises means for effecting transfer of said package and tube simultaneously.

21. Apparatus in combination with a row of winders each of which winds filamentary material upon tubes supported for rotation about vertically spaced rotary axes of the winder to form packages, said apparatus servicing each winder by removing a package from a respective axis and replacing the package with a tube and comprising:

a carrier mounted for movement generally parallel to the row of winders, means for positioning said carrier selectively at locations for servicing respective winders, package exchange means including an arm mounted on said carrier for up-and-down movement and being positionable opposite an axis of a winder being serviced so that the package can be transferred from the axis to the package exchange arm, tube exchange means including an arm mounted on said carrier for up-and-down movement and being positionable opposite the axis so that a tube on the tube exchange arm can be transferred to the axis, first and second vertically spaced positioning means for positioning said package exchange means and tube exchange means selectively at either of said vertically spaced axes, shuttle means spaced above the row of winders, and including a package transfer arm and a tube transfer arm, means vertically moving said package exchange means and said tube exchange means to the general level of said shuttle means, means for effecting transfer of the package from the package exchange arm to the package transfer arm and for effecting transfer of a tube from said tube transfer arm to said tube exchange arm, and means for propelling said shuttle means to a remote station where the package is removed from said package transfer arm and a tube is installed on said tube transfer arm.

22. Apparatus in combination with a row of winders each of which winds filamentary material upon a tube supported for rotation about a rotary axis of the winder to form a package, said apparatus servicing each winder by removing a package from the winder and replacing the package with a tube and comprising:

a carrier suspended from above the row of winders for movement generally parallel to the row of winders, means positioning said carrier selectively at locations for servicing respective winders, a column mounted on said carrier for horizontal movement relative thereto, package exchange means including an arm mounted on said column for up-and-down movement and being positionable opposite the rotary axis of a winder being serviced so that the package can be transferred from the winder to the package exchange arm, tube exchange means including an arm mounted on said column for up-and-down movement and being positionable opposite the rotary axis so that a tube exchange arm can be transferred to the rotary axis, shuttle means spaced horizontally from and vertically above the row of winders, and including a package transfer arm and a tube transfer arm, means vertically moving said package exchange arm and said tube exchange arm along said column to the general level of said shuttle means, means for effecting transfer of the package from the package exchange arm to the package transfer arm and for simultaneously effecting transfer of a tube from said tube transfer arm to said tube exchange arm, and means for propelling said shuttle means to a remote station where the package is removed from said package transfer arm and a tube is installed on said tube transfer arm.

* * * * *